US009540808B2

(12) United States Patent
Remmele

(10) Patent No.: US 9,540,808 B2
(45) Date of Patent: Jan. 10, 2017

(54) CASING ACCESSORIES

(71) Applicant: STO CORP., Atlanta, GA (US)

(72) Inventor: Thomas E. Remmele, Powder Springs, GA (US)

(73) Assignee: Sto Corp., Atlanta, GA (US)

( * ) Notice: Subject to any disclaimer, the term of this patent is extended or adjusted under 35 U.S.C. 154(b) by 0 days.

(21) Appl. No.: 14/847,459

(22) Filed: Sep. 8, 2015

(65) Prior Publication Data

US 2016/0069071 A1 Mar. 10, 2016

Related U.S. Application Data

(60) Provisional application No. 62/047,703, filed on Sep. 9, 2014.

(51) Int. Cl.

| | |
|---|---|
| ***E04B 9/00*** | (2006.01) |
| ***E04B 2/02*** | (2006.01) |
| ***E04B 2/10*** | (2006.01) |
| ***E04C 2/34*** | (2006.01) |
| ***E04C 2/52*** | (2006.01) |
| ***E04F 13/06*** | (2006.01) |

(Continued)

(52) U.S. Cl.

CPC ..... *E04B 2/02* (2013.01); *E04B 1/765* (2013.01); *E04B 1/7641* (2013.01); *E04B 2/10* (2013.01);

(Continued)

(58) Field of Classification Search

CPC ..... E04B 1/70; E04B 1/7038; E04B 1/7069; E04B 1/7046; E04B 1/7053; E04B 1/7023; E04B 1/765; E04B 1/762; E04B 2/707; E04B 2002/028; E04F 19/02; E04F 13/08; E04F 2013/065; E04F 17/00; E04F 13/068; E04F 13/06; E02D 31/02; E02D 31/025

(Continued)

(56) References Cited

U.S. PATENT DOCUMENTS 3,672,108 A * 6/1972 Conway ..... E04B 1/7023 52/367
4,869,032 A * 9/1989 Geske ..... E02D 31/02 405/43

(Continued)

FOREIGN PATENT DOCUMENTS

| | | |
|---|---|---|
| DE | 3235979 A1 | 3/1984 |
| EP | 0468163 A2 | 1/1992 |
| WO | 9963183 A1 | 12/1999 |

OTHER PUBLICATIONS

International Searching Authority. International Search Report and Written Opinion, International application No. PCT/US2015/048859.Nov. 27, 2015.

*Primary Examiner* — Chi Q Nguyen
(74) *Attorney, Agent, or Firm* — Thomas B. McGurk

(57) ABSTRACT

The present disclosure is directed to casing accessories for use with multi-component wall systems. Some of the casing accessories of the present disclosure can include a mounting bracket to attach the accessory to a wall structure and a channel formed in part by a spacer that can be adjusted to adjust the channel width in order to encase components of multi-component wall systems that can vary in width from one installation to another. In another aspect, some of the casing accessories can include one or more drainage canals that direct water from one part of the casing accessories to another. In another aspect, some of the casing accessories can impede fire propagation through multi-component wall systems.

8 Claims, 22 Drawing Sheets

(51) Int. Cl.

| | |
|---|---|
| *E04B 1/70* | (2006.01) |
| *E04F 13/08* | (2006.01) |
| *E02D 31/02* | (2006.01) |
| *E04B 2/70* | (2006.01) |
| *E04F 17/00* | (2006.01) |
| *E04B 1/76* | (2006.01) |

(52) U.S. Cl.

CPC . *E04C 2/34* (2013.01); *E04C 2/52* (2013.01); *E04F 13/06* (2013.01); *E04F 13/068* (2013.01); *E02D 31/02* (2013.01); *E02D 31/025* (2013.01); *E04B 1/70* (2013.01); *E04B 1/7023* (2013.01); *E04B 1/7038* (2013.01); *E04B 1/7046* (2013.01); *E04B 1/7053* (2013.01); *E04B 1/7069* (2013.01); *E04B 1/762* (2013.01); *E04B 2/707* (2013.01); *E04B 2002/0202* (2013.01); *E04B 2002/028* (2013.01); *E04F 13/0808* (2013.01); *E04F 17/00* (2013.01); *E04F 2013/063* (2013.01); *E04F 2013/065* (2013.01)

(58) Field of Classification Search

USPC ..... 52/479, 480, 483.1, 302.1, 302.3, 302.6, 52/220.3, 220.4, 62, 98–100, 302.7

See application file for complete search history.

(56) References Cited

U.S. PATENT DOCUMENTS

| | | | | |
|---|---|---|---|---|
| 6,119,429 | A * | 9/2000 | Bifano | E04B 1/765 52/101 |
| 6,293,064 | B1 * | 9/2001 | Larson | E04B 1/762 52/209 |
| 6,385,932 | B1 * | 5/2002 | Melchiori | E04F 13/06 52/302.3 |
| 6,410,118 | B1 * | 6/2002 | Reicherts | B32B 13/04 428/141 |
| 6,470,638 | B1 * | 10/2002 | Larson | E04B 1/765 52/254 |
| 7,302,776 | B2 * | 12/2007 | Duncan | E04D 13/17 454/260 |
| 7,832,150 | B1 * | 11/2010 | Pratt | E04B 1/7023 52/169.5 |
| 7,836,640 | B1 * | 11/2010 | Pratt | E04B 1/7023 52/169.5 |
| 2005/0284045 | A1 | 12/2005 | Smith | |
| 2007/0169425 | A2 | 7/2007 | Takagi | |
| 2007/0180785 | A1 * | 8/2007 | Trotter | E02D 31/02 52/302.1 |
| 2012/0324814 | A1 * | 12/2012 | Amend | E04F 13/0875 52/302.1 |

* cited by examiner

CASING ACCESSORIES

RELATED APPLICATION

This application claims the benefit of priority to U.S. Provisional Application No. 62/047,703, filed Sep. 9, 2014. The provisional application identified above is hereby incorporated by reference in its entirety herein to provide continuity of disclosure.

TECHNICAL FIELD

The present disclosure is directed to wall system components, and, more specifically, to casing accessories for multi-component wall systems.

BACKGROUND

A recent development in the construction industry is the growing popularity of continuous insulation, which is designed to extend across structural members in a continuous manner and configured to minimize thermal bridging. Some popular types of continuous insulation include rigid foam, mineral wool, biomass, and wood insulation, any of which can be installed on the exterior side of the structural members of a building construction. With the advent of continuous insulation as a frequent requirement in wall construction of new building products, various issues have arisen including those relating to the effectiveness of fire protection, moisture management, the maintenance of edge integrity of the wall assembly after installation, and the management of variations in wall assembly thickness during installation. For wall systems incorporating continuous insulation, moisture management becomes an important issue due to the lack of openings in the continuous layer that would otherwise allow for movement of moisture from interior to exterior portions of the wall assemblies. Variation in the thickness of different insulation panel products result in installed wall assemblies varying in thickness from one building to another. For manufacturers of wall systems and accessories, such as starter tracks, variations in wall thickness from one installation to another necessitate the need to produce different versions of a given accessory in order to accommodate the varying thicknesses, thereby potentially increasing manufacturing and inventory costs. Furthermore, wall assemblies containing continuous insulation often are thicker than wall assemblies containing traditional types of insulation resulting in thicker assembly edges that are more prone to wear and tear.

Other challenges arise in the area of wall assemblies and construction. For example, fire safety has always been an issue in construction. With the advent of modern materials and construction techniques, the need for construction features and components that can tend to resist the spread of fire has persisted. Furthermore, the constructability of wall systems has been and continues to be a target for improvements. Oftentimes, adjustments to wall assemblies at the time of installation are necessary to achieve the desired appearance, performance and durability of the finished product. Yet current designs of wall systems often do not provide the necessary flexibility to achieve such adjustments efficiently or effectively. Additional challenges include water management, not just in installations with continuous insulation panels, but other wall systems that are exposed to weather.

Consequently, there is a need for wall accessories that can address one or more of these and related issues. The present disclosure addresses this need and provides additional aspects that can prove useful in the construction industry.

SUMMARY

The present disclosure is directed to casing accessories for the construction industry. The casing accessories of the present disclosure can be used to encase a portion of one or more edges of one or more components of a multi-component wall system. In one aspect, the casing accessories can be used to encase one or more edges of wall assemblies containing continuous insulation.

In one embodiment, the present disclosure is directed a casing accessory for a multi-component wall system comprising a front component comprising a retaining wall, a rear component operably connected to the front component, wherein the rear component comprises a mounting bracket, wherein the mounting bracket is aligned proximal to a wall support structure when the casing accessory is mounted to the wall support structure, a spacer extending at least a portion of a distance between the mounting bracket and the retaining wall, wherein the spacer maintains spacing between the retaining wall and the mounting bracket when the casing accessory is mounted to the wall support structure, wherein the retaining wall, the spacer, and the mounting bracket cooperate to form a channel for encasing a portion of a component of a multi-component wall system, wherein the channel comprises an adjustable channel width and wherein the adjustable channel width is adjustable by adjustment of the spacer.

In another aspect, the spacer can be integrally formed with only one of the rear component and the front component. In a further aspect, the spacer can be detachably connected to at least one of the rear component and the front component. In yet another aspect, at least one of the rear component and the front component comprises a receiver, and wherein the receiver engages a portion of the spacer. In still a further aspect, the spacer can comprise a width adjuster formed thereon, wherein the adjustable channel width is adjusted by adjustment of the width adjuster. In yet another aspect, the spacer can comprise a plurality of the width adjusters formed thereon. In a further aspect, the width adjuster can comprise a detachable member, and wherein the adjustable channel width is adjustable by removing the detachable member from the spacer. In another aspect, the spacer can comprise a score line delineating the detachable member. In a further aspect, the mounting bracket and the spacer can form a first angle greater than about 90°, and wherein the first angle is interior to the channel. In still a further aspect, the retaining wall and the spacer form a second angle of less than about 90°, and wherein the second angle is interior to the channel. In yet another aspect, the mounting bracket and the spacer can form a first angle, and the retaining wall and spacer can form a second angle, and wherein the second angle is less than the first angle. In a further aspect, the mounting bracket and the spacer can form a first angle in a range of about 90° to about 105°. In another aspect, the retaining wall and the spacer can form a second angle in a range of about 75° and about 90°. In another aspect, the casing accessory can comprise a drainage canal having a first end aligned proximal to the mounting bracket and a second end aligned distal to the mounting bracket. In still a further aspect, the spacer can comprise a drainage wall forming a portion of the drainage canal. In yet another aspect, at least a portion of the drainage canal can be disposed on a receiver formed in the rear component. In still another aspect, the front component further can comprise a flange extending downward from the retaining wall and away from the channel. In a further aspect, the retaining wall can comprise a mesh layer. In yet another aspect, the channel further can comprise a first channel leg and a second channel leg. In one aspect, the first channel leg can be disposed perpendicular to the second channel leg. In another aspect, a second channel can be formed in the casing accessory for receiving a portion of a second component of a multi-component wall system. In a further aspect, the casing accessory can comprise a second retaining wall defining a portion of the second channel.

The present disclosure also encompasses a casing accessory for a multi-component wall system comprising a mounting bracket for mounting the casing accessory to a wall support structure, a retaining wall operably connected to the mounting bracket, and, a spacer operably connecting the retaining wall and the mounting bracket, wherein the spacer is detachably connected to at least one of the mounting bracket and the retaining wall, and wherein the mounting bracket, the retaining wall and the spacer cooperate to form a channel for encasing a portion of a component of a multi-component wall system, and wherein the channel comprises an adjustable channel width.

In one aspect, the spacer can comprise a width adjuster for adjusting the adjustable channel width. In another aspect, the width adjuster can comprise a detachable member. In a further aspect, the casing accessory can comprise a drainage canal extending away from the mounting bracket. In still another aspect, the casing accessory can further comprise a plurality of the drainage canals. In yet another aspect, the casing accessory further can comprise a plurality of drainage walls forming the plurality of drainage canals. In a further aspect, the plurality of drainage walls can be formed on the spacer. In yet a further aspect, the mounting bracket and the spacer can form a first angle interior to the channel and wherein the retaining wall and the spacer can form a second angle interior to the channel and wherein the first angle is greater than the second angle. In still another aspect, the casing accessory further can comprise a flange depending from the retaining wall and away from the channel. In yet another aspect, the retaining wall can comprise a mesh layer. In another aspect, the casing accessory further can comprise a receiver integrally formed with one of the mounting bracket and the retaining wall, and wherein the receiver engages a portion of the spacer. In still a further aspect, the channel further can comprise a first channel leg and a second channel leg. In yet another aspect, the first channel leg can be disposed perpendicular to the second channel leg. In a further aspect, the casing accessory further can comprise a second channel formed therein for receiving a portion of a second component of a multi-component wall system. In a further aspect, the accessory can comprise a second retaining wall defining a portion of the second channel. In yet another aspect, at least one of the retaining wall and the second retaining wall can comprise a mesh layer.

The present disclosure also encompasses a casing accessory for a multi-component wall system comprising a rear component comprising a mounting bracket for mounting the casing accessory to a wall support structure, a front component comprising a retaining wall, wherein the front component is operably connected to the rear component, and, a spacer extending between the mounting bracket and the retaining wall, wherein the spacer is integrally formed with one of the front component and the rear component and detachably connected to one of the front component and the rear component, wherein the retaining wall, the spacer and the mounting bracket cooperate to form a channel therein, wherein the channel is configured to receive a component of a multi-component wall system, and wherein the spacer comprises a width adjuster for adjusting an adjustable width of the channel.

In one aspect, the width adjuster can comprise a detachable member. In another aspect, the mounting bracket and the spacer can form a first angle interior to the channel and wherein the retaining wall and the spacer can form a second angle interior to the channel and wherein the second angle is less than the first angle. In a further aspect, the casing accessory can comprise a plurality of drainage canals extending away from the mounting bracket. In yet another aspect, the retaining wall can comprise a mesh layer. In still another aspect, the channel further can comprise a first channel leg and a second channel leg. In a further aspect, the first channel leg can be disposed perpendicular to the second channel leg. In another aspect, the casing accessory further can comprise a second channel formed therein for receiving a portion of a second component of a multi-component wall system. In a further aspect, the rear component, the front component and the spacer can be formed of a fire-resistant material.

The present disclosure also encompasses a casing accessory for a multi-component wall system comprising a mounting bracket for mounting the casing accessory to a wall support structure, a retaining wall operably connected to the mounting bracket, a spacer operably connecting the retaining wall and the mounting bracket, wherein the mounting bracket, the retaining wall and the spacer cooperate to form a channel for encasing a portion of a component of a multi-component wall system and, a drainage canal having a first end and a second end, wherein the first end is aligned proximal to the mounting bracket and the second end is aligned distal to the mounting bracket.

In one aspect, the drainage canal can be formed on the spacer. In another aspect, the casing accessory further can comprise a plurality of the drainage canals. In a further aspect, a portion of the drainage canal can be formed by a drainage wall. In still a further aspect, the drainage walls can be formed on the spacer. In yet another aspect, the drainage canal can be formed on a receiver operably connected to at least one of the mounting bracket and the retaining wall, wherein the receiver engages a portion of the spacer to operably connect the spacer to at least one of the retaining wall and the mounting bracket. In still another aspect, the mounting bracket and the spacer can form a first angle greater than about 90°, and wherein the first angle is interior to the channel. In a further aspect, the retaining wall and the spacer can form a second angle of less than about 90°, and wherein the second angle is interior to the channel. In another aspect, the mounting bracket and the spacer can form a first angle, and wherein the retaining wall and spacer form a second angle, and wherein the second angle is less than the first angle. In a further aspect, the mounting bracket and the spacer can form a first angle in a range of about 90° to about 105°. In still another aspect, the retaining wall and the spacer can form a second angle in a range of about 75° and about 90°. In another aspect, the casing accessory can further comprise an abutment disposed in the channel and wherein the abutment separates the portion of the component of the multi-component wall system from the mounting bracket when the portion of the component is disposed in the channel. In another aspect, the casing accessory further can comprise a width adjuster operably connected to the spacer, wherein the channel comprises an adjustable channel width that is adjustable by adjustment of the width adjuster.

These and other aspects are encompassed by the present disclosure and set forth in more particularity in the detailed description below and the accompanying drawings that are briefly described as follows.

DETAILED DESCRIPTION

Figure 1:
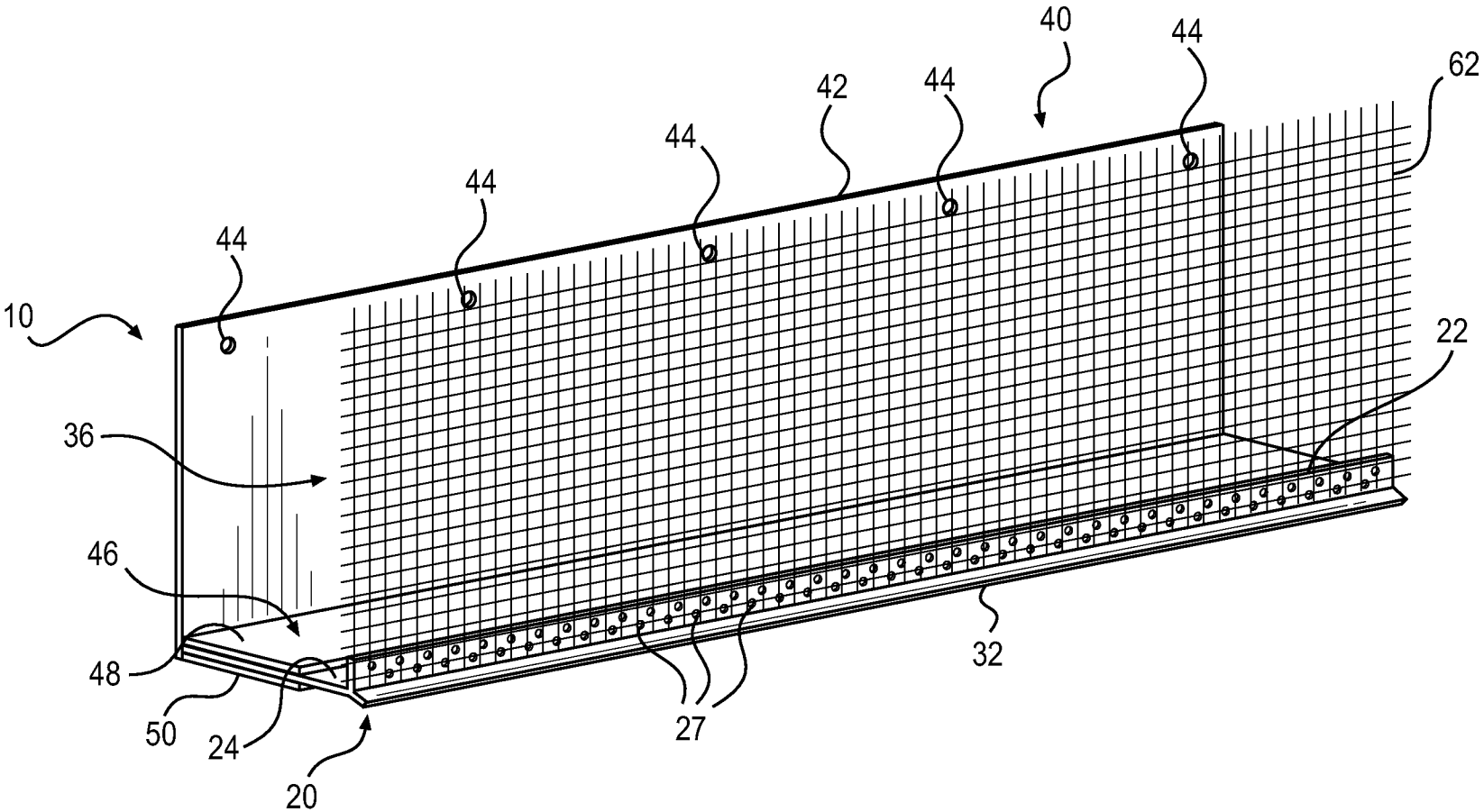
FIG. 1 is a perspective view of a portion of a casing accessory encompassing aspects of the present disclosure.

The present disclosure is directed to casing accessories usable with multi-component wall systems that can be installed on building structures. The casing accessories of the present disclosure can be used to encase a portion of one or more components of a multi-component wall system. The casing accessories of the present disclosure can be used to enclose one or more edges and/or sides of a wall assembly and/or portions thereof, such as those including continuous insulation panels. Examples of multi-component wall systems with which the casing accessories of the present disclosure can be used include stucco wall systems, exterior insulation and finishing systems (EIFS), cement board stucco wall systems and other systems known in the art. In one aspect, the present disclosure encompasses casing accessories that can be used with a variety of multi-component wall systems whose depths or widths vary from one installation to another. Some of the casing accessories of the present disclosure can allow an installer to adjust the width or depth of the casing accessory in the field in order to accommodate the depth of the components of the multi-component wall system with which the accessory is being used. The casing accessories of the present disclosure can be used to encase a portion or all of a side, bottom, and/or top edge of a component of a multi-component wall system. The casing accessories of the present disclosure can be used to cover or to encase all or a portion of one, two, or three surfaces of one or more components of a multi-component wall system, such as for example one or more surfaces of a continuous insulation panel. Some of the casing accessories of the present disclosure also can allow an accessory manufacturer to streamline accessory production with fewer production variations while still providing accessories with the necessary dimensions to accommodate more than one of the varying depths of multi-component wall systems that are used in the construction industry. Some casing accessories of the present disclosure can provide conduits by which water or moisture is directed from interior portions of a multi-component wall system to exterior portions thereof. In another aspect, some casing accessories of the present disclosure can be formed of fire resistant material that can tend to impart fire resistant characteristics to the accessories, thereby, in some instances, possibly reducing the speed and/or blocking the spread of fire from one wall system component to another or within the wall system.

As used herein, the singular forms of "a," "an," and "the" encompasses the plural form thereof unless otherwise indicated. As used herein, the phrase "at least one" includes all numbers of one and greater. The ranges used herein include all values that would fall within the stated range, including values falling intermediate of whole values. As used herein, the term "and/or" refers to one or all of the listed elements or a combination of any two or more of the listed elements.

As used herein, the term "multi-component wall system" refers to a system used in constructing structural walls that includes more than one component of dissimilar type arranged in layers across the span of the wall. The wall system can include one or more cladding layers or components mounted to the underlying wall support structure, which can be framing, framing/substrate, masonry construction, and/or other conventional wall support structures. The cladding layers or components can include, but are not limited to, one or more insulation panels, substrate layers, adhesive layers, base coat layers, air barriers, water barriers, mesh layers, finish layers and other wall system layers known in the art. Examples of multi-component wall systems include, but are not limited to, stucco, EIFS, cement board stucco, and other types of claddings.

As used herein, the term "casing accessory" refers to an apparatus having a channel formed therein and that can be mounted to an underlying wall support structure and aligned to encase a portion of one or more edges of one or more components of a multi-component wall system. Where the "casing accessory" is configured to operate as a starter track, the accessory can be positioned to provide a seat for one or more components of a multi-component wall system and facilitate the installation of the multi-component wall system on a building or other structure.

As used herein, the term "encase" refers to covering, enclosing, and/or terminating partially or completely indirectly or directly one or more surfaces or edges of a component of a multi-component wall system. As used herein, the term "integrally formed with" refers two components being made of a single piece of material, or manufactured as a whole piece through a known process for combining two or more components to form a whole, such as, but not limited to, by welding, fusing, soldering, or riveting, wherein the whole is not configured to be separated into the two separate components after combining has occurred.

As used herein, the term "detachably connected" refers to joining of one component to another by means configured to allow for the separation of the components at the point of attachment. As used herein, the term "operably connected" refers to the cooperation of two or more parts to perform a function as intended. As used herein, the term "detachable member" refers to a piece of a component that is configured to be removed optionally from the component. As used herein, the term "spacer" can refer to a single component or more than one component that cooperate to maintain the distance between a mounting bracket and a retaining wall and/or maintain the width of the channel formed by the accessories encompassed by the present disclosure, and can encompass a combination of a spacer operably connected to a receiver, or a spacer that has receiver aspects incorporated therein.

FIG. 1 discloses a casing accessory 10 encompassing aspects of the present disclosure. The casing accessory 10 includes a front component 20 operably connected to a rear component 40. The front component 20 of the present disclosure generally refers to a part of the casing accessory 10 that is aligned proximal to the exterior surface of a multi-component wall system when installed, and the rear component 40 of the present disclosure generally refers to a part of the casing accessory 10 that is aligned proximal the underlying wall support structure when installed. The front component 20 includes a retaining wall 22 and a spacer 24 integrally formed with the retaining wall 22 and extending away therefrom. The retaining wall 22 extends the length of the casing accessory 10 and includes a plurality of mating holes 27 formed therein to allow a component, such as an insulation panel, disposed within the channel 36 of the casing accessory 10 to adhere to a component applied to the outside of the retaining wall 22, such as a water barrier, spacer coat, finish coat or finish layer. Extending from the bottom of the retaining wall 22 and away from the spacer 24 is a flange 32. The flange 32 can extend outward away from the front surface of the retaining wall 22 at an angle of less than 180°. The flange can provide an angled surface for moisture to flow downward and away from the face of the multi-component wall system with which the casing accessory 10 is used. The retaining wall 22 further comprises a mesh layer 62 that extends the length of the retaining wall 22 and is aligned parallel to the mounting bracket 42. The mesh layer 62 can improve the adherence of other layers of a wall system to the insulation panel partially encased by the casing accessory 10. The casing accessory 10 includes a channel 36 formed by the cooperation of the retaining wall 22, the spacer 24, the receiver 46, and the mounting bracket 42. The channel 36 can extend the length of the casing accessory 10 and is configured to receive one or more components, such as insulation panels, of a multi-component wall system. The width of the channel 36 is defined by the sidewalls thereof, which are formed by the mounting bracket 40 and the retaining wall 22. The channel width is adjustable and can be adjusted by adjustment of the spacer 24 in order to accommodate multi-component wall systems of varying depth.

As shown in FIG. 1, the front component 20 is connected to the rear component 40 by the attachment of the rear portion of the spacer 24 to the receiver 46 of the rear component 40. The receiver 46 is connected to and integrally formed with the mounting bracket 42, which, as shown in FIG. 1, is a wall extending the length of the casing accessory 10. The receiver 46 comprises a first receiver wall 48 and a parallel second receiver wall 50. As shown in FIG. 4A, a receiver slot 51 is formed between the first receiver wall 48 and the second receiver wall 50 and can extend the length of the rear component 40. The rear portion of the spacer 24 can be inserted into the receiver slot 51 and frictionally retained therein to connect the front component 20 to the rear component 40. In addition to the frictional retention of the spacer 24 in the slot 51, alternative means of fastening the front component 20 to the rear component 40 can be provided and are contemplated by the present disclosure. For example, one or more mating dimples, not shown, located on the spacer 24 and on one or both of the first receiver wall 48 and second receiver wall 50 can be provided to fasten the front component 20 to the rear component 40. Alternatively, catches, hooks, adhesives or other fasteners can be employed to attach the front component 20 to the rear component 40.

Figure 2A:
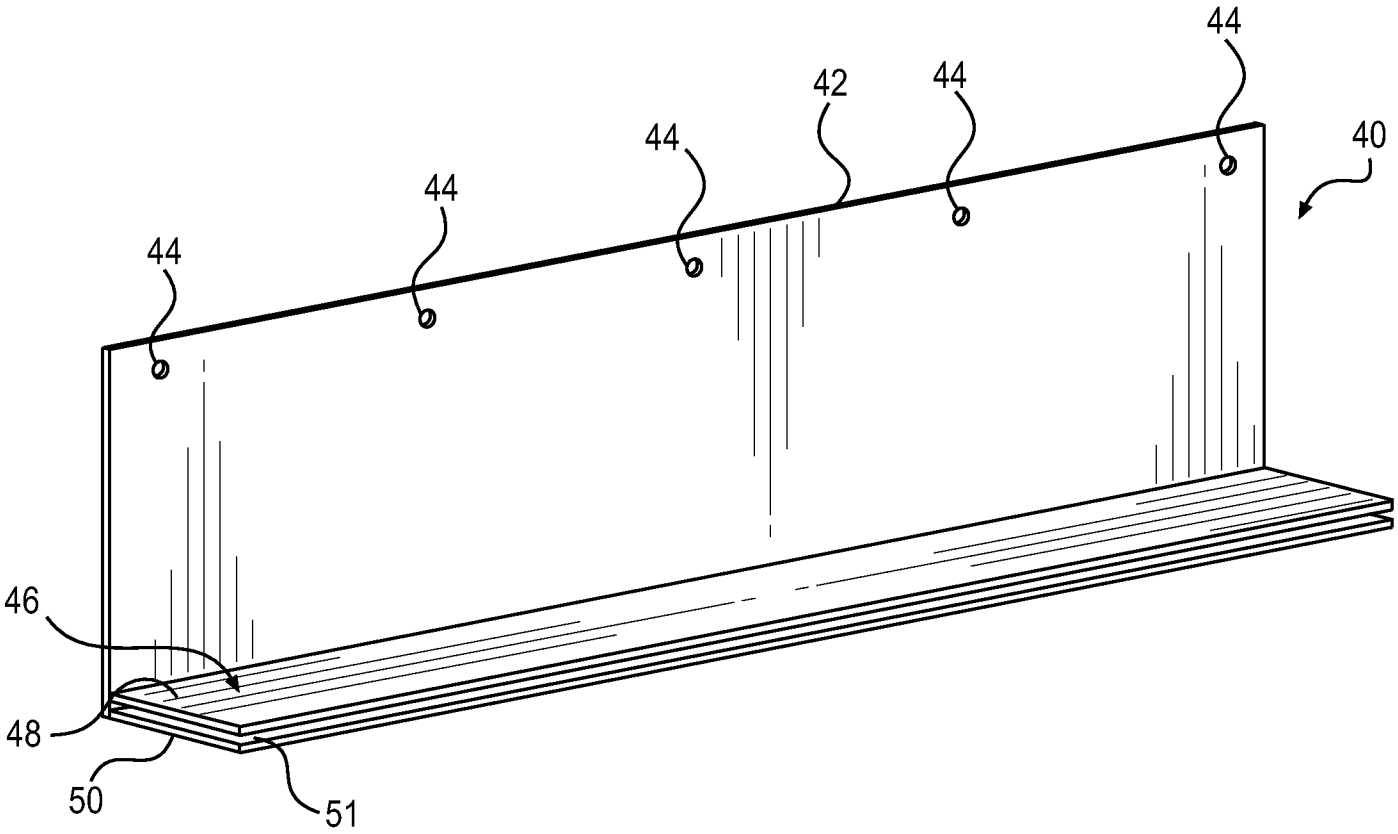
FIG. 2A is a perspective view of the rear component of the casing accessory shown in FIG. 1 with the front component removed.

FIG. 2A shows a perspective view of the rear component 40 of the casing accessory 10. The rear component 40 includes the mounting bracket 42, which has a plurality of optional fastener apertures 44 positioned at intervals along its length. The mounting bracket 42 comprises an upwardly extending wall; however, the casing accessories of the present disclosure can include other structures that serve as brackets for mounting the casing accessory to a wall support structure. For example, the mounting bracket 42 can include one or more merlons forming a crenellation along the length of the casing accessory 10. The present disclosure encompasses alternative structures imparting sufficient strength to the casing accessory to receive and support one or more portions of a multi-component wall system. The first receiver wall 48 of the receiver 46 can provide a surface upon which one or more components of a multi-component wall system can be positioned as the multi-component wall system is installed. In one example, the rear component 40 can include a mounting bracket 42 of approximately three inches (76 mm) in height and a receiver 46 extending approximately one inch (25 mm) from the mounting bracket 42.

Figure 2B:
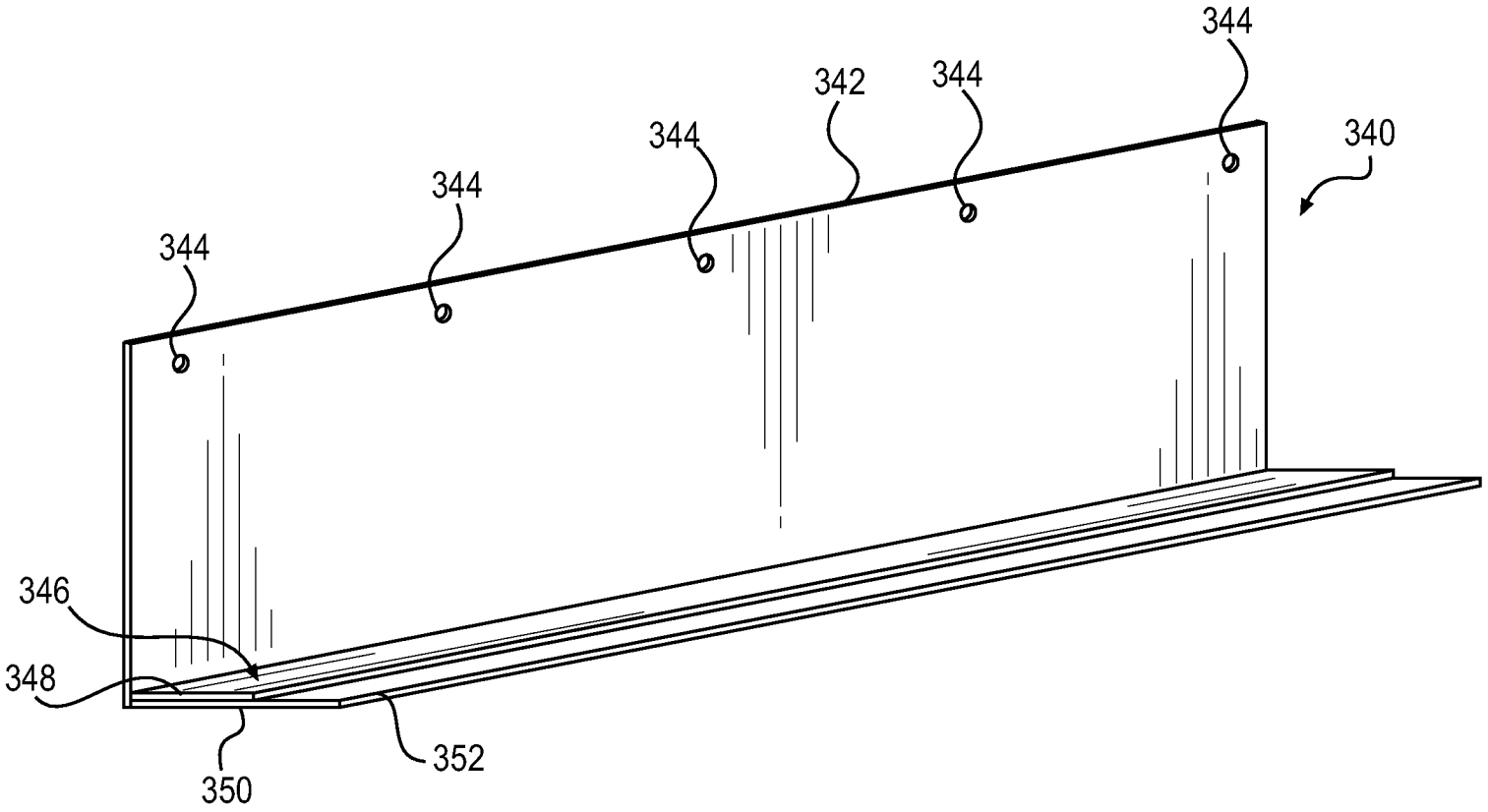
FIG. 2B is a perspective view of another rear component of a casing accessory encompassing aspects of the present disclosure.

FIG. 2B shows another example of a rear component 340 that can be used in casing accessories encompassing aspects of the present disclosure. Like the rear component 40, shown in FIG. 2A, the rear component 340 includes a mounting bracket 342 with a plurality of optional fastener apertures 344 formed therein and a receiver 348 extending from a lower portion thereof. The receiver 348 includes a receiver 346 positioned above a second step 350, which extends below and outward therefrom. The rear component 340 can have dimensions similar to those of the rear component 40 set forth in FIG. 2A. Likewise, the mounting bracket 342 and the retainer 346 of rear component 340 can be aligned to form angles within ranges similar to those formed by the parts of the rear component 40 set forth in FIG. 2A and other rear components described herein. The alignment of the first and the second steps 346 and 350 forms a seat 352 on which the spacer 24 of a front component 20 can be positioned or aligned, when operably connecting the front and rear components of a casing accessory.

Figure 3:
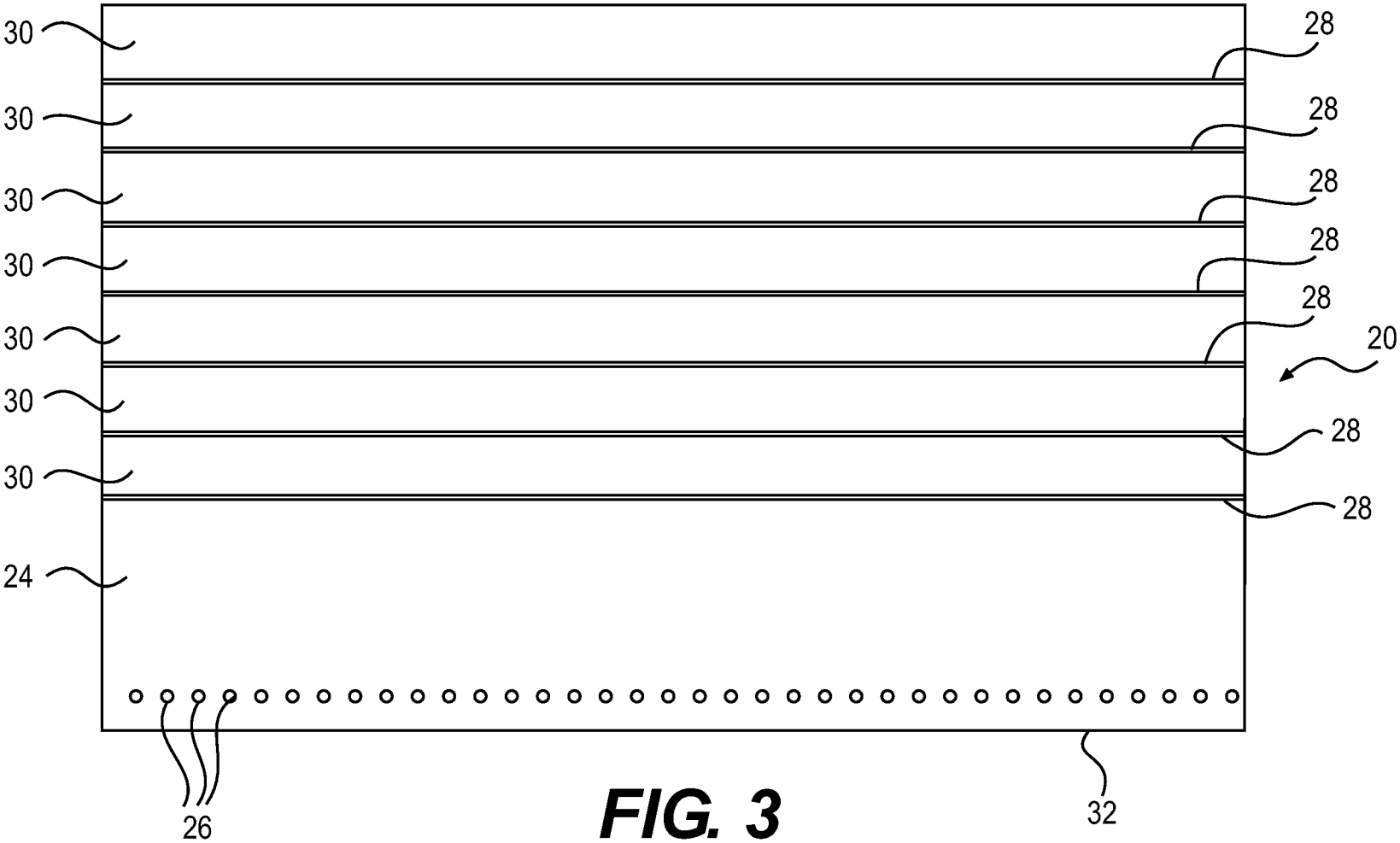
FIG. 3 is a bottom view of a front component of a casing accessory encompassing aspects of the present disclosure.

As shown in FIG. 3, the front component 20 includes a spacer 24 in which is formed a plurality of drainage holes 26 spaced along its length and arranged to provide pathways through which moisture can drain from an interior portion of a multi-component wall system. Also provided on the spacer 24 are one or more width adjusters 30 that can serve as part of the support structure of the spacer 24 and optionally can be detached or folded so to allow for the reduction in the width of the spacer 24. In one example, the front component 20 includes one or more score lines 28 extending along a least portion of the length of the spacer 24 and delineating the plurality of width adjusters 30 that take the form of detachable members. As shown in FIG. 3, seven score lines 28 are disposed intermittently along the width of the spacer 24. The score lines 28 can be provided at pre-determined points along the width of the spacer 24; for example, the score lines 28 can be spaced approximately one inch or 25 mm apart with the first score line 28 beginning approximately 25 mm from one edge of the spacer 24. The score lines 28 can be evenly distributed across the entire surface of the spacer 24, or, as shown in FIG. 3, the score lines can be distributed across a major portion of the surface of the spacer 24. Alternatively, the score lines 24 can extend over less than a majority of the width of the spacer 24. The score lines 24 can be continuous lines extending the length of the spacer 24 or can be intermediate dashed lines extending across the length of the spacer 24 to the exterior edges of the spacer 24.

The score lines 28 define a plurality of the width adjusters 30 formed in the spacer 24 of the front component 20. Unlike the views of the front component 20 shown in FIGS. 1, 5, and 6, FIG. 3 shows the front component 20 with all of the width adjusters 30 attached to the spacer 24 as originally manufactured. The width adjusters 30 can be of equal width, as shown in FIG. 3, or, alternatively, of differing width depending upon the intended use of the accessory. The width adjusters 30 can be of predetermined width, for example one inch or approximately 25 mm. Indicia, not shown, indicating the width of each width adjuster 30 can be provided on or formed in the spacer 24 to aid the installer in determining the appropriate width of the spacer 24. The adjustability of the spacer 24 allows for the width of the channel 36 to be adjusted in order to provide the optimal width to support or encase the multi-component wall system in which the casing accessory 10 is to be used. In the front component 20 shown in FIG. 3, each width adjuster 30 can be folded or detached from the front component 20 by breaking or cutting the strip along the score lines 28. The adjustability of the spacer 24 allows for the spacer 24 to be configured into eight different widths by folding or removing the appropriate number of width adjusters 30. While the width adjusters 30 shown in FIG. 3 take the form of strips that are delineated by score lines 28, the present disclosure also encompasses detachable members with alternative configurations but that can be removed to adjust the width of the spacer and the adjustable channel width of the casing accessory.

In one example, the front component 20 can include a spacer 24 approximately five inches (127 mm) in width with seven width adjusters 30 formed therein, each approximately one half inch (13 mm) in length. The spacer 24 includes a non-scored section approximately one and one half inch (38 mm) in width disposed between the retaining wall 22 and the first score 28. The retaining wall 22 includes a plurality of drainage holes approximately 3/16 of an inch (5 mm) in diameter and aligned every three inches (76 mm) on center.

FIG. 4A shows a side view of the rear component 40 including the mounting bracket 42, and the receiver 46 formed of the first receiver wall 48 and the second receiver wall 50 and having a receiver slot 51 formed therein. A first angle 55 is shown in FIG. 4A extending from the mounting bracket 42 to the first receiver wall 48. This first angle 55 can vary by degree depending upon the desired configuration of the channel 36 formed in the casing accessory 10. In one aspect, the angle 55 between the mounting bracket 42 and the receiver 46 can be greater than or equal to about 90°. In another aspect, the angle 55 can be about 95°. In still a further aspect, the angle 55 can be in a range of about 90° to about 100°. In yet another aspect, the angle 55 can be in the range of about 90° to about 105°. With angle 55 being at an angle of 90° or greater, the casing accessory 10 can provide drainage away from interior portions of the wall system outward to the outer surface of the wall system. The first and the second receiver walls 48 and 50 can be of different lengths.

Figure 4B:
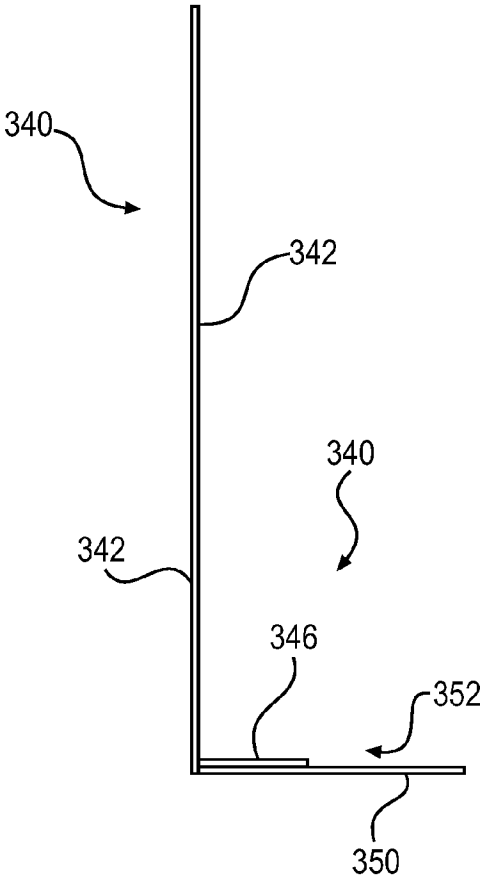
FIG. 4B is a side elevation view of the rear component shown in FIG. 2B.
Figure 4A:
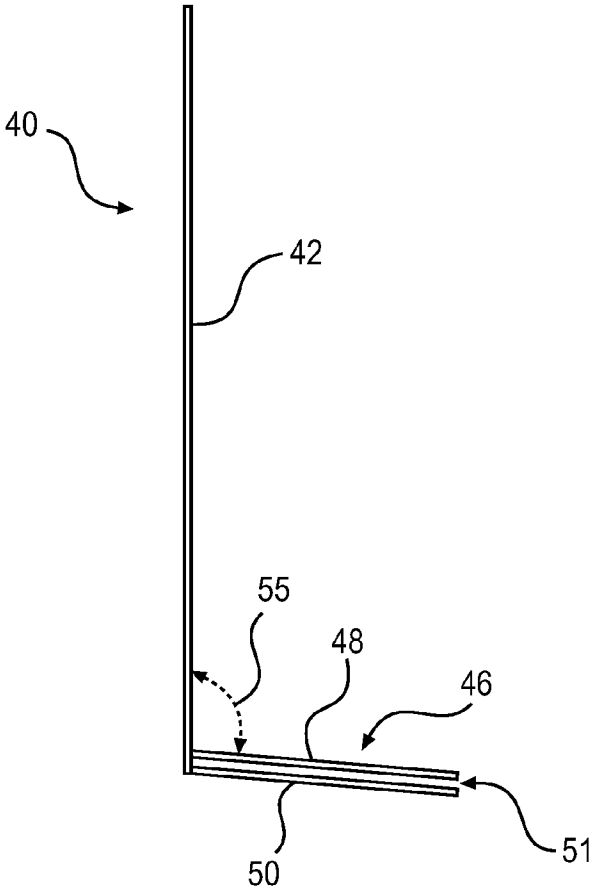
FIG. 4A is a side elevation view of the rear component shown in FIG. 2A.

FIG. 4B shows a side view of the rear component 340 shown in FIG. 2B. The first step 346 extends from the mounting bracket 342 and can be aligned at about 90° angle thereto. The second step 350 extends away from the first step 346 and the mounting bracket 342 and can form a seat 352 with the cooperation of the first step 346. In one embodiment, the second step 350 extends a length of approximately 25 mm or one inch measured from the rear edge of the rear component 340. The first step can extend approximately 8 mm or one third of an inch form the rear surface of the rear component 340. The seat 352 can receive a portion of a receiver formed on a front component so as to operably connect the rear component to the front component to form a casing accessory.

Figure 5B:
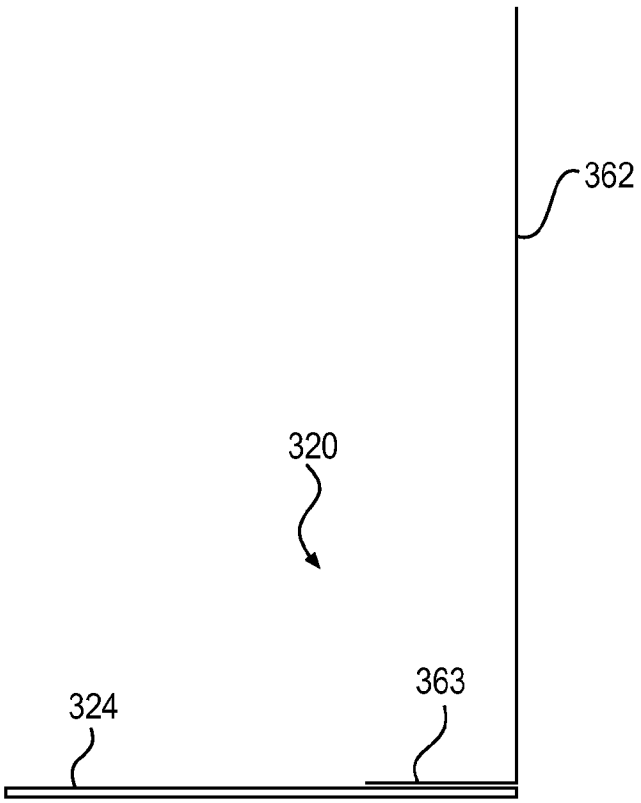
FIG. 5B is a side elevation view of another front component of a casing accessory encompassing aspects of the present disclosure.
Figure 5A:
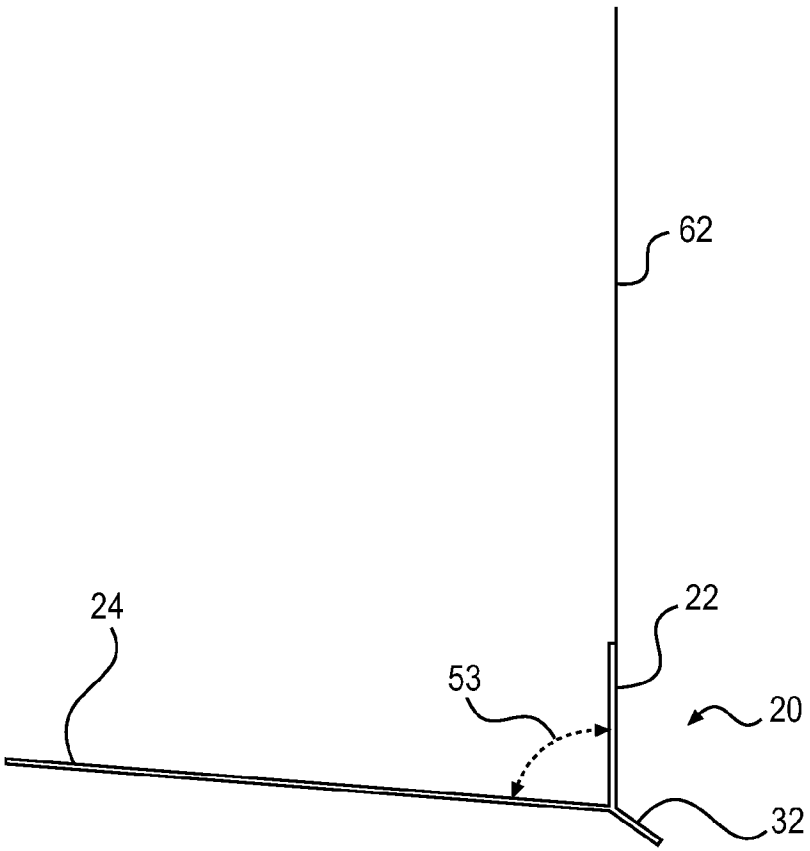
FIG. 5A is a side elevation view of the front component of the casing accessory shown in FIG. 1 with the rear component removed.

FIG. 5A shows the front component 20 with some of the width adjusters 30 removed from the spacer 24. The front component 20 includes a retaining wall 22 extending upward from the spacer 24. The retaining wall includes a mesh layer 62. The mesh layer 62 is aligned parallel to the mounting bracket 42 of the rear component 40 when the front and rear components 20 and 40 are operably connected. The second angle 53 formed between the retaining wall 22 and the spacer 24 can be less than or equal to about 90°. In another aspect, the angle 53 can be in the range of about 80° to about 90°. In still a further aspect, the angle 53 can be in the range of about 75° to about 90°. In yet another aspect, the second angle 53 can be about 85°. The flange 32 extends downward and away from the spacer 24. The angle between the front face of the retaining wall 22 and the flange 32 can be greater than or equal to about 90°. The second angle 53 and the first angle 55 can be configured to total 180° when the front component 20 is operably connected to the rear component 40, thereby making the first angle 55 and the second angle 53 supplementary angles. When the first angle 55 and the second angle 53 are supplementary angles the mounting bracket 42 can be parallel to the retaining wall 22. The present disclosure also encompasses casing accessories in which the first angle 55 and the second angle 53 are not supplementary angles and accessories in which the mounting bracket and the retaining wall are not aligned in parallel. With either alternative, the first angle 55 can be greater than the second angle 53 in order to allow moisture to flow down and across the channel 36 of the casing accessory 10 and outward to the exterior of the multi-component wall system in which the casing accessory 10 is used.

FIG. 5B shows a front component 320 that can be used with the various rear components encompassed hereby. The front component 320 includes a spacer 324, which can be a flat rectangular sheet with a length longer than the width thereof. The spacer 324 can include one or more detachable members extending along a portion or the entire length thereof and that server as width adjusters to allow for adjustment of the width of the spacer 324 by the detachment of one or more of the detachable members. In one embodiment, one or more of the detachable members can be approximately 13 mm or 0.5 inch in width. In one embodiment, the spacer 324 can include seven detachable members formed therein each approximately 13 mm in width. The spacer of the casing accessories encompassed by the present disclosure can include an adjustable section and a non-adjustable section. The adjustable section can include the one or more width adjusters that can be folded, bent or detached. In one embodiment, the adjustable section can have a width of approximately 89 mm or 3.5 inches, and the non-adjustable section can be approximately 38 mm or 1.5 inches in width, and the entire spacer can be approximately 127 mm or 5 inches in width. Each of the adjustable and non-adjustable sections can extend the length of the spacer 324. The spacer 324 can include more or less detachable strips of the same or different widths as needed. The spacer 324 includes a mesh layer 362 attached thereto and extending therefrom and which serves as a retaining wall. As shown in FIG. 5B, the mesh layer 362 can extend away from the spacer 324 at an angle of approximately 90°. Other angles also are contemplated by the present disclosure. The mesh layer can include a leg 363 aligned on the top surface of the spacer 324 to enhance the attachment of the mesh layer 362 to the spacer 324.

Figure 6A:
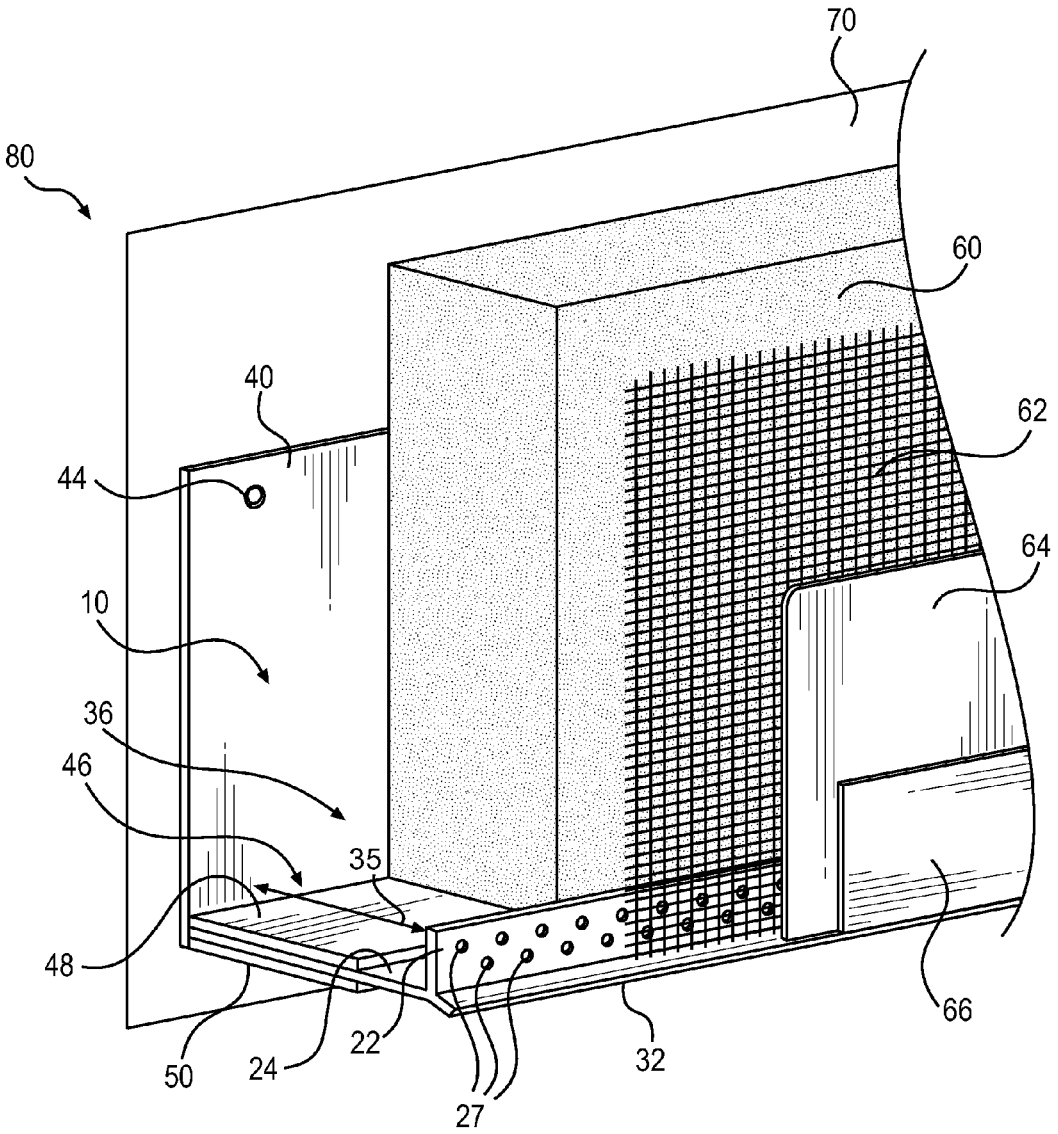
FIG. 6A is a perspective view of a section of a multi-component wall system including a casing accessory encompassing aspects of the present disclosure.

FIG. 6A shows the casing accessory 10 of the present disclosure installed in a multi-component wall system 80. The multi-component wall system 80 includes an underlying wall support structure 70, which can include framing and a substrate. The casing accessory 10 is mounted to the underlying wall support structure 70 by one or more fasteners disposed in the fastener apertures 44 formed in the mounting bracket 42. The fastener apertures 44 are optional components provided within the mounting bracket 42, which alternatively can be configured to be mountable to a wall support structure without such apertures. The mounting bracket 42 is aligned adjacent and proximal the underlying wall support structure 70 with the receiver 46 extending outward from the underlying wall support structure 70 and downward from the mounting bracket 42. The appropriate numbers of width adjusters, not shown, are detached from the spacer 24 to provide a channel 36 with an adjustable channel width 35 suitable for the type of multi-component wall system 80 in which the casing accessory 10 is used. The spacer 24 of the front component 20 is inserted between the first receiver wall 48 and the second receiver wall 50 of the receiver 46, and thereby frictionally retained the receiver 46. The retaining wall 22 extends upward from the spacer 24 and the flange 32 extends downwardly therefrom. An insulation layer 60 is disposed in the channel 36 defined by cooperation of the receiver 46, the spacer 24, the retaining wall 22, and the mounting bracket 42. The channel 36 has an adjustable channel width 35 that can be adjusted by the adjustment of the spacer 24 and/or receiver 46 or combination thereof as they cooperate with each other. As shown in FIG. 6A, the insulation layer 60 is an insulation panel that forms a part of a continuous insulation installation. The retaining wall 22 includes a mesh layer 62 aligned on and supported by flange 32. The mesh layer 62 extends upward serves as an interface between the insulation layer 60 and one or more air barriers, water barriers, adhesive layers or other coating layers 64. On the outside surface of the multi-component wall system 80 is installed a finish layer 66. As shown in FIG. 6A, the casing accessory 10 serves as a support upon which the one or more layers of the multi-component wall system 80 can be mounted.

Figure 6C:
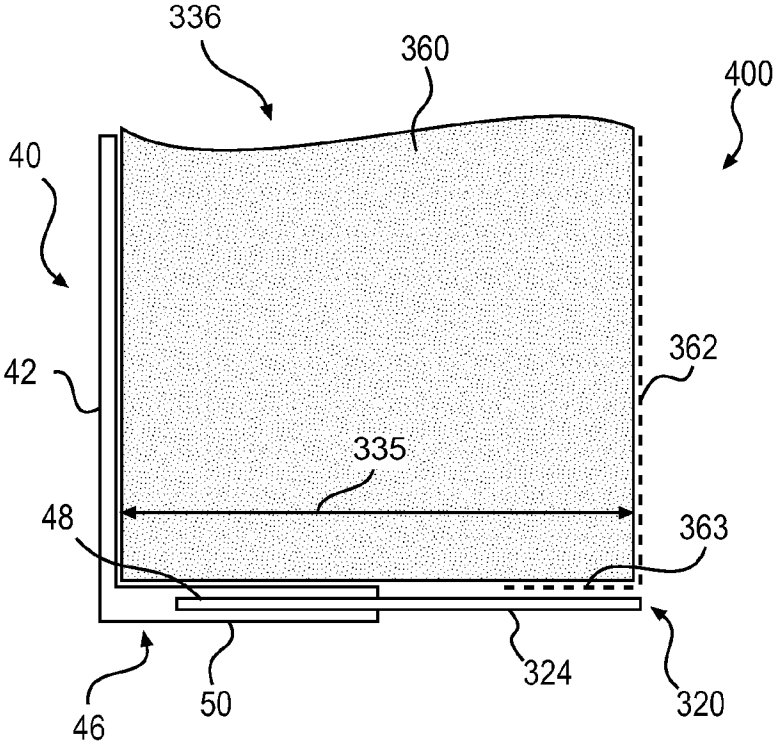
FIG. 6C is a side view of a section of a multi-component wall system including yet another casing accessory encompassing aspects of the present disclosure.
Figure 6B:
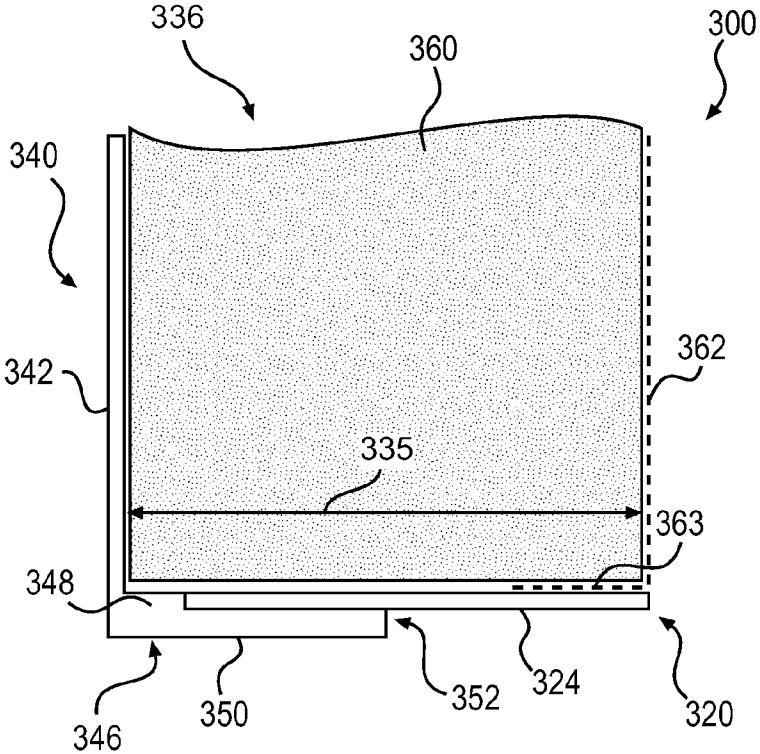
FIG. 6B is a side view of a section of a multi-component wall system including another casing accessory encompassing aspects of the present disclosure.

FIG. 6B shows a side view of another casing accessory 300 encompassing aspects of the present disclosure installed in a multi-component wall system and encasing a portion of a continuous insulation panel 360. The casing accessory 300 includes a front component 320 operably connected to a rear component 340. The front component 320 includes a spacer 324 with a retaining wall formed of a mesh layer 362 extending therefrom and leg 363 of the mesh layer 362 attached on the top surface of the spacer 324. The rear component 340 includes a mounting bracket 342 and a receiver 348 extending from a lower portion thereof. The receiver 348 includes a first step 346 extending at about a 90° angle from the mounting bracket 342 and a second step 350 extending below and beyond the first step 346. The first step 346 and the second step 350 are aligned to form a seat 352 on which the spacer 324 can be seated to operably connect the front component 320 to the rear component 340. The spacer 324 can be affixed in the seat 352 by one or more attachment means as set forth herein, such as tabs, dimples, clasps, adhesives, and other fasteners. The width of the spacer 324 can be adjusted by removing or adjusting one or more width adjusters to provide the desired width 335 for the channel 336 formed therein. The casing accessory 300 encases a portion of the insulation panel 360. The casing accessory 300 covers a portion of the bottom surface of the insulation panel 360, as well as portions of the front and rear faces of the panel 360, thereby encasing the edge of the panel 360. The front component 320 and the rear component 340 cooperate to form a channel 336 in which at least a portion of the continuous insulation panel 360 is disposed. The channel 336 includes an adjustable channel width 335 that is adjustable by the adjustment of the spacer 324 or the combination of the spacer 324 and the receiver 348. Within FIG. 6B space is shown around the continuous insulation panel 360 in order to show the position of the mesh layer leg 363, but in practice the continuous insulation panel 360 can be in physical contact with one or more of the side bracket 342, the receiver 346, the spacer 324, the mesh layer 362 and the mesh layer leg 363. The casing accessory 300 can be used on various portions of a multi-component wall system, such as, for example, along vertical edges of an EIFS assembly where a solid retaining wall on the outer surface of the wall assembly is not necessary.

FIG. 6C shows yet another embodiment of a casing accessory 400 encompassing aspects of the present disclosure. The casing accessory 400 includes a front component 320 as disclosed in FIG. 6B. The accessory also includes a rear component 40 as shown in FIG. 2B, but with the angle between the receiver 46 and the mounting bracket 42 being approximately 90°. The casing accessory 400 highlights the interchangeability of the components set forth herein and is shown encasing a portion of a continuous insulation panel 360 that is disposed in the channel 336 formed by the cooperation of the mounting bracket 42, the receiver 46, the spacer 324 and the mesh layer 362. The adjustable channel width 335 of the channel 336 can be adjusted by the adjustment of one or more of the spacer 325, receiver 46 and/or the mesh layer 326. Within FIG. 6C space is shown around the continuous insulation panel 360 in order to show the position of the mesh layer leg 363, but in practice the continuous insulation panel 360 can be in physical contact with one or more of the side bracket 42, the top wall 48 of the retainer 46, the spacer 324, the mesh layer 362 and the mesh layer leg 363. The casing accessory 400 can be used on various portions of a wall assembly, such as, for example, along vertical edges where a solid retaining wall on the outer surface of the wall assembly is not necessary.

Figure 7:
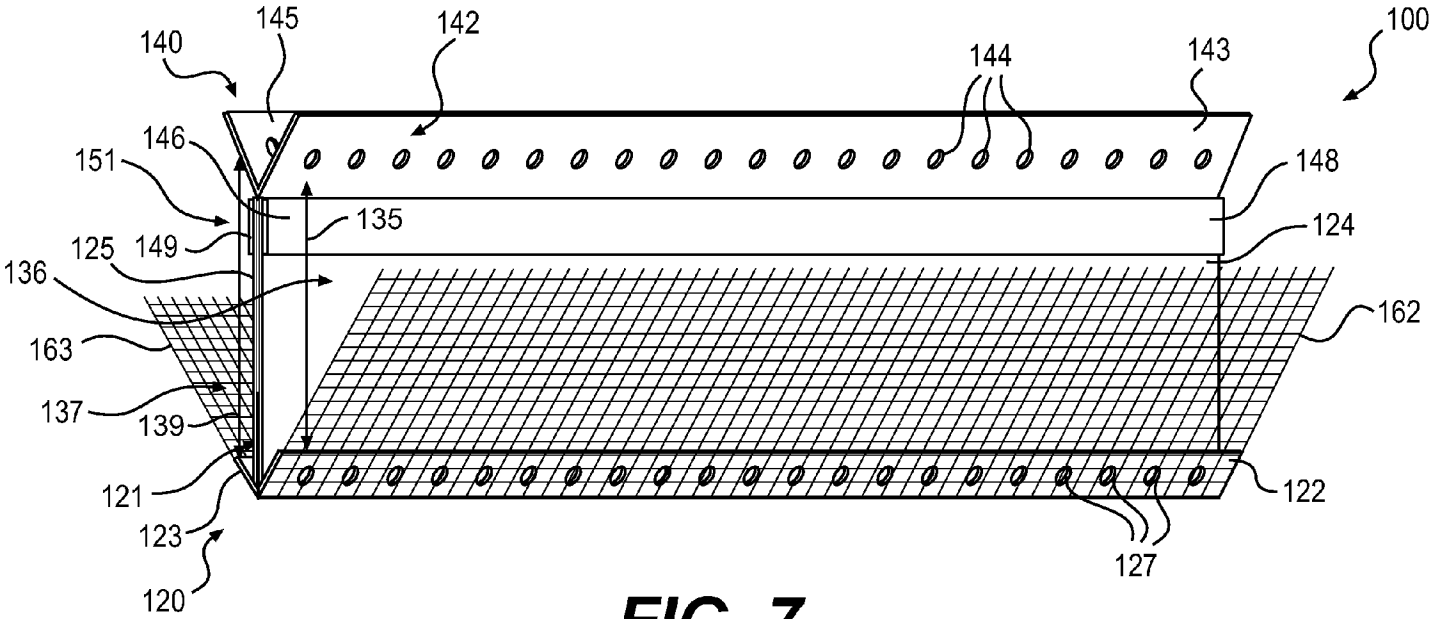
FIG. 7 is a perspective view of another casing accessory encompassing aspects of the present disclosure.

FIG. 7 shows another embodiment of a casing accessory encompassed by the present disclosure. The casing accessory 100 is designed to be mounted along an edge of a corner of a structure where two walls or structure surfaces meet and to encase a portion of two or more wall components disposed along adjacent surfaces of the structure. The casing accessory 100 includes a front component 120 operably connected to a rear component 140. The rear component 140 is mountable along an edge of a building structure and the front component 120 extends outwardly therefrom. The front component 120 includes a spacer comprising a first spacer wall 124 and a second spacer wall 125. The first and the second spacer walls 124 and 125 are aligned parallel to each other and have a spacer channel 121 formed there between. From the first spacer wall 124 extends a first retaining wall 122, and from the second spacer wall 125 extends a second retaining wall 123. Depending upon the angle of the corner of the structure to which the casing accessory 100 is to be disposed, each of the first and the second retaining walls 122 and 123 can be aligned to form an angle of approximately 45° between it and the spacer wall from which it extends. The angles formed by the retaining walls and the spacer walls can differ from 45° depending upon the configuration of the wall structure with which it is used. To the first retaining wall 122 is attached a first mesh layer 162, and to the second retaining wall is attached a second mesh layer 163. Portions of the first and the second mesh layers 162 and 163 are aligned at the same angles, relative to the spacer walls 124 and 125, as are the retaining walls 122 and 123. The first retaining wall 122 can be aligned parallel to the first bracket wall 143 and the second retaining wall 123 can be aligned parallel with the second bracket wall 145. In this configuration, the casing accessory 100 can define two channels 136 and 137 that are aligned to be congruent with the underlying support structure. Each channel 136 and 137 includes an adjustable channel width 135 and 139, respectively, that is adjusted by the adjustment of one or more of the spacers 124 and 125, the receiver 146 and the retaining walls 122 and 123, respectively.

Figure 8:
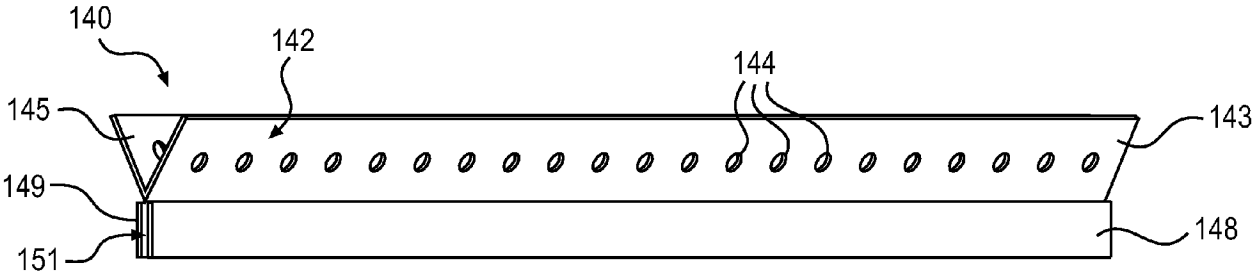
FIG. 8 is a perspective view of the rear component of the casing accessory shown in FIG. 7 with the front component removed.

FIG. 8 shows the rear component 140 of the casing accessory 100 shown in FIG. 7 detached from the front component 120. The rear component 140 includes a two-sided mounting bracket 142 formed of a first bracket wall 143 and a second bracket wall 145. The first and the second bracket walls 143 and 145 form about a 90° angle, or whatever angle that corresponds to the underlying wall structure, so as to allow the mounting bracket 140 to be attached to two surfaces of a wall structure, such as along the edge of a corner of a building. The mounting bracket 142 has a plurality of optional fastener apertures 144 formed therein to allow for fasteners to be inserted there through. The mounting bracket 142 is integrally formed with a receiver 146 formed of a first receiver wall 148 and a second receiver wall 149. The first and the second receiver walls 148 and 149 extend the length of the rear component 140 and are spaced apart to form a receiver slot 151 that is aligned to receive the first and second spacer walls 124 and 125 of the first component 120 of the casing accessory 100.

Figure 9:
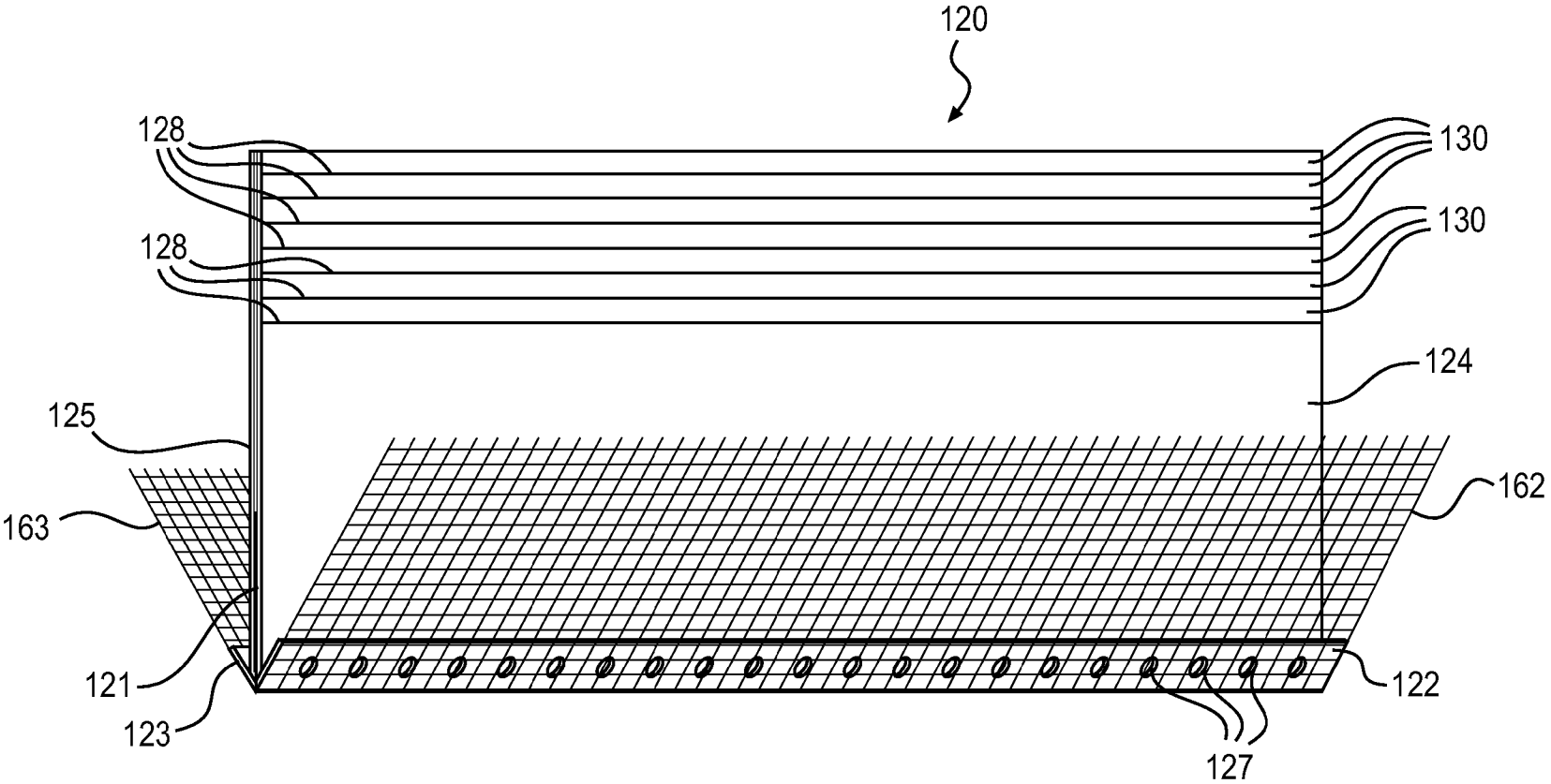
FIG. 9 is a perspective view of a front component of a casing accessory encompassing aspects of the present disclosure.

FIG. 9 shows the front component 120 of the casing accessory 100 shown in FIG. 7 with width adjusters 130 not yet removed or otherwise adjusted. The front component 120 comprises a spacer comprised of a first spacer wall 124 and a second spacer wall 125. The first and the second spacer walls 124 and 125 are spaced apart and aligned parallel to each other. The spacing of the first and the second spacer walls 124 and 125 form a spacer channel 121 there between in which a portion of each of the first and second mesh layers 162 and 163 can be disposed so as to improve the adherence of the mesh layers to the front component 120. The first mesh layer 162 wraps around and extends from the first retaining wall 122, which is attached to the first spacer wall 124. The second mesh layer 163 wraps around and extends from the second retaining wall 123, which is attached to the second spacer wall 124. A plurality of width adjusters 130, in the form of detachable members separated by score lines 128, are shown on the first spacer wall 124. The second spacer wall 125 also includes a plurality of width adjusters separated by score lines to allow for the adjustment of the width of the spacer of the accessory 100, and, therefore, the adjustment of the channel widths of each channel 136 and 137 formed by the casing accessory 100 to allow the accessory to encase the edges of wall assemblies of various depths.

Figure 10A:
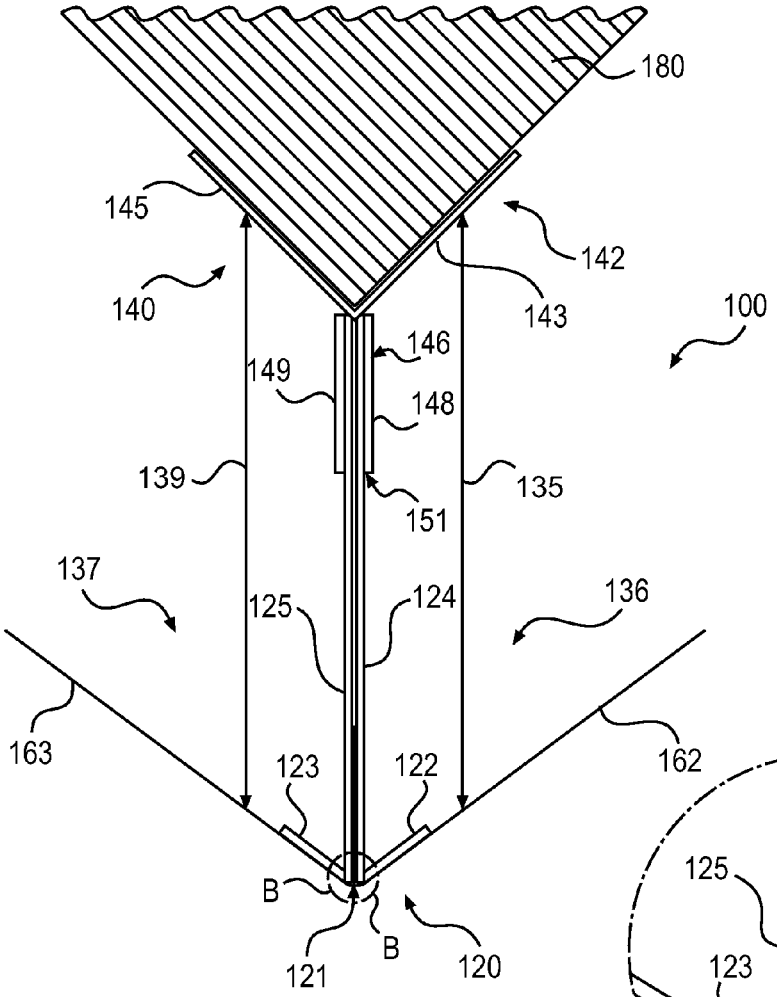
FIG. 10A is a top view of the casing accessory shown in FIG. 7 installed on a building structure.
Figure 10B:
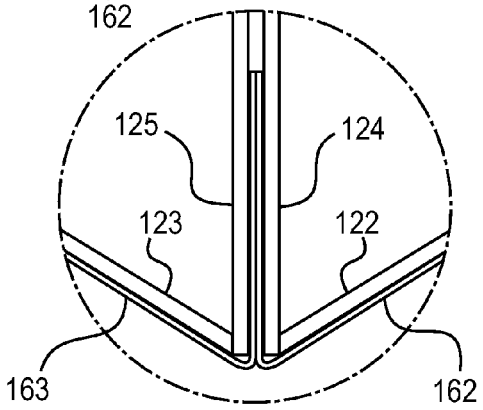
FIG. 10B is an enlarged top view of the portion of the casing accessory shown in FIG. 10A within circle B-B.

FIG. 10A shows the casing accessory 100 installed on a building wall support structure 180. The casing accessory 100 is aligned along an edge of the building wall support structure 180 where two surfaces of the structure meet, such as the vertical edge of the corner of a building. The mounting bracket 142 is attached to the building structure 180 by fasteners, not shown. The first bracket leg 143 is mounted to a first surface of the building structure 180 and the second bracket leg 145 is mounted to a second surface of the building structure 180. The receiver 146, which includes the first receiver wall 148 and the second receiver wall 149, extends outwardly from the edge of the building structure. Disposed in the receiver slot 151 are portions of the first spacer wall 124 and the second spacer wall 125. In the spacer slot 121 formed between the first spacer wall 124 and the second spacer wall 125 are sandwiched portions of the first mesh layer 162 and the second mesh layer 163. Extending at about 45° angles from the outer edges of the first spacer wall 124 and the second spacer wall 125 are the first retaining wall 122 and the second retaining wall 123. FIG. 10 B shows the portions of the first and second mesh layers 162 and 163 sandwiched in the spacer slot 121 formed between the first spacer wall 124 and the second spacer wall 125 and the angle formed by the first and the second retaining walls 122 and 123. The mesh layers 162 and 163 extend beyond the first and the second retaining walls respectively and are aligned generally in parallel with the two abutting surfaces of the building structure 180. A first channel 136 and an adjacent second channel 137 are formed in the casing accessory and are provided to encase the edges of one or more components, such as insulation panels, of the multi-component wall system of which the casing accessory 100 forms a part.

Figure 11:
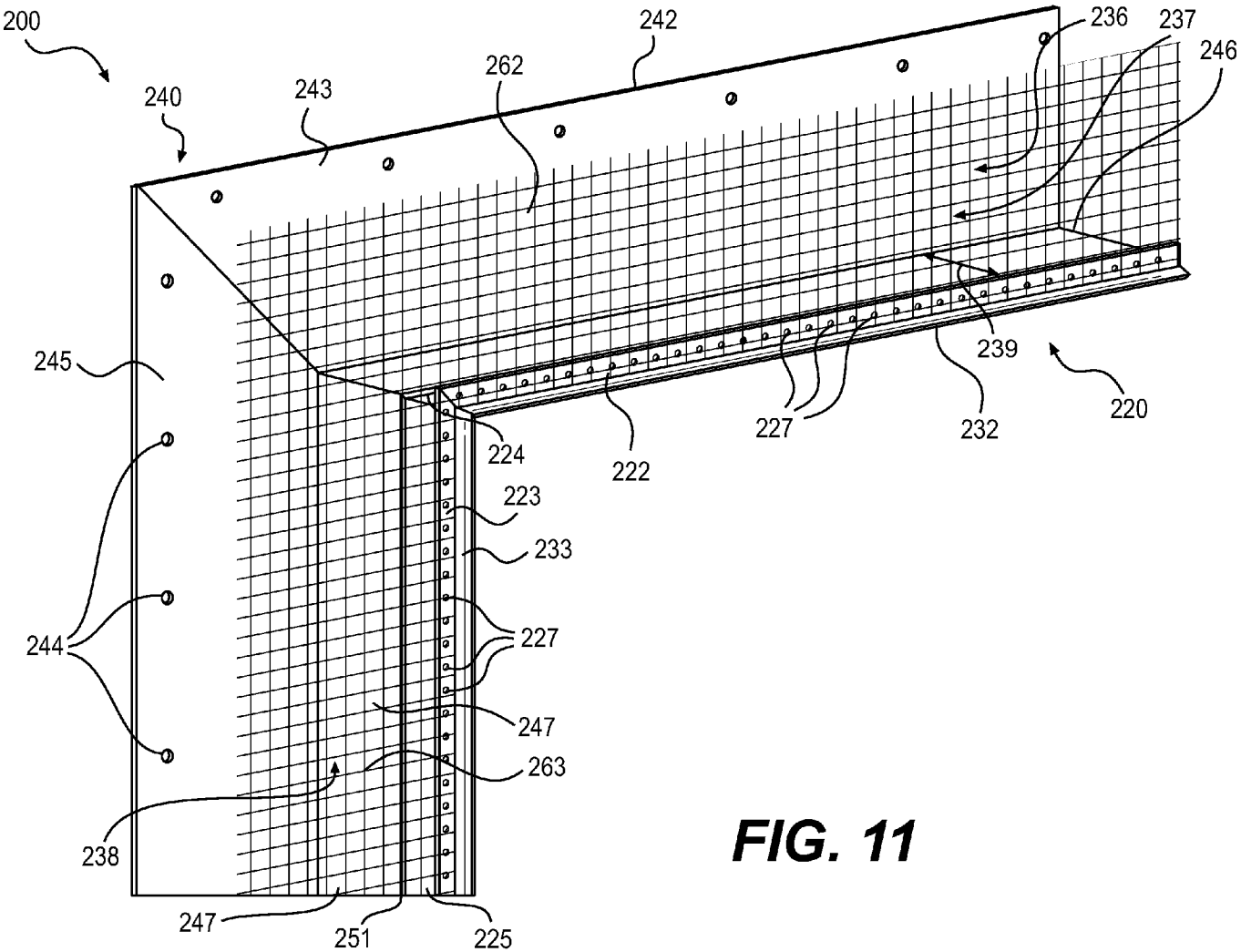
FIG. 11 is a perspective view of a portion of yet another casing accessory encompassing aspects of the present disclosure.

FIG. 11 shows yet another embodiment of a casing accessory encompassing aspects of the present disclosure. The casing accessory 200 includes a first leg and a second leg that are aligned to form a 90° angle. Casing accessories having a first and a second leg formed therein and encompassed by the present disclosure can form angles other than right angles as necessary to encase the edges of the wall assembly components with which the accessories are used. The two-leg casing accessory 200 can be installed adjacent a door, a window, or other types of interruptions in a wall surface and can encase the edges of the wall assembly components abutting these interrupting structures. The casing accessory 200 has a channel 236 formed therein. The channel 236 has an angle of about 90° formed therein and made up of the first channel leg 237 and the second channel leg 238. The channel 236 also includes an adjustable channel width 239 that extends from the first mounting bracket 242 to the first retaining wall 222, and, likewise, from the second mounting bracket 245 to the second retaining wall 223. The adjustable channel width 239 is adjustable by adjustment of the first and the second spacer legs 224 and 225.

The casing accessory 200 includes a front component 220 operably connected to a rear component 240. Both the front component 220 and the rear component 240 have a 90° angle formed therein and mate to form the 90° channel 236. The configuration of the front component 220 and the rear component allow for encasement of the edges of one or more components of a wall assembly at a corner formed along the wall structure. The front component 220 includes the first retaining wall 222 and the second retaining wall 223. The first retaining wall 222 is attached to the second retaining wall 223 and in combination with the retaining wall 223 forms an angle of approximately 90°. Each of the first and the second retaining walls 222 and 223 have a plurality of mating holes 227 formed therein. The mating holes 227 allow for the bonding of coating components used in the wall assembly with the surface of the wall assembly component positioned in the accessory channels. The front component 220 includes a spacer having a 90° angle formed therein and comprised of the first spacer leg 224 and the second spacer leg 225. The first retaining wall 222 is attached to and extends from the first spacer leg 224, and the second retaining wall 223 is attached to and extends from the second spacer leg 225. From the first retaining wall 222 extends a first flange 232 and from the second retaining wall 223 extends a second flange 233. The first and the second flanges 232 and 233 are configured to support a mesh layer thereon. Attached to the first component 220 is a mesh layer having a 90° angle formed therein. The first and the second spacer legs 224 and 225 can include one or more strips formed therein and similar to the width adjusters 30 formed on the spacer 20 shown in FIG. 3. Scores similar to those scores can separate these strips 28 shown in FIG. 3.

The rear component 240 includes a mounting bracket 242 having a 90° angle formed therein and comprising a first bracket leg 243 and a second bracket leg 245. Each of the first and the second bracket legs 243 and 245 have a plurality of fastener holes 244 formed therein to receive fasteners to secure the accessory 200 to a wall support structure. The mounting bracket 240 is integrally formed with a receiver that includes a first receiver leg 246 and a second receiver leg 247. Within the receiver is a receiver slot 251 into which the first and second spacer legs 224 and 225 can be inserted to operably connect the first component 220 to the second component 240.

FIGS. 12-19 illustrate another embodiment of a casing accessory encompassed by the present disclosure. The casing accessory 500 includes a plurality of drainage canals 580 disposed at the base of the channel 536 to allow for water and moisture to drain away from the wall support structure to which the accessory 500 is mounted and to drain toward an outer surface of the multi-component wall system of which the accessory 500 is a part. The drainage canals 580 include a first end aligned proximal to the mounting bracket 542 and a second end aligned distal to the mounting bracket 542. Water can flow from the first end to the second end and outward from the multi-component wall system. The front component 520 and the rear component 540 when installed in a multi-component wall system are aligned so that the rear component 540 is proximal the underlying wall support structure to which the accessory 500 is mounted and the front component 520 is aligned distal to the underlying wall support structure. Furthermore, the front component 520 is aligned proximal to the outer surface of the multi-component wall system and the rear component 540 is aligned distal to an outer surface of the multi-component wall system of which the accessory 500 is a part. The front component 520 and the rear component 540 can be manufactured as two separate components and then operably combined after manufacturing, such as at the time of installation to form the casing accessory 500 that has a channel 536 formed therein.

Figure 12:
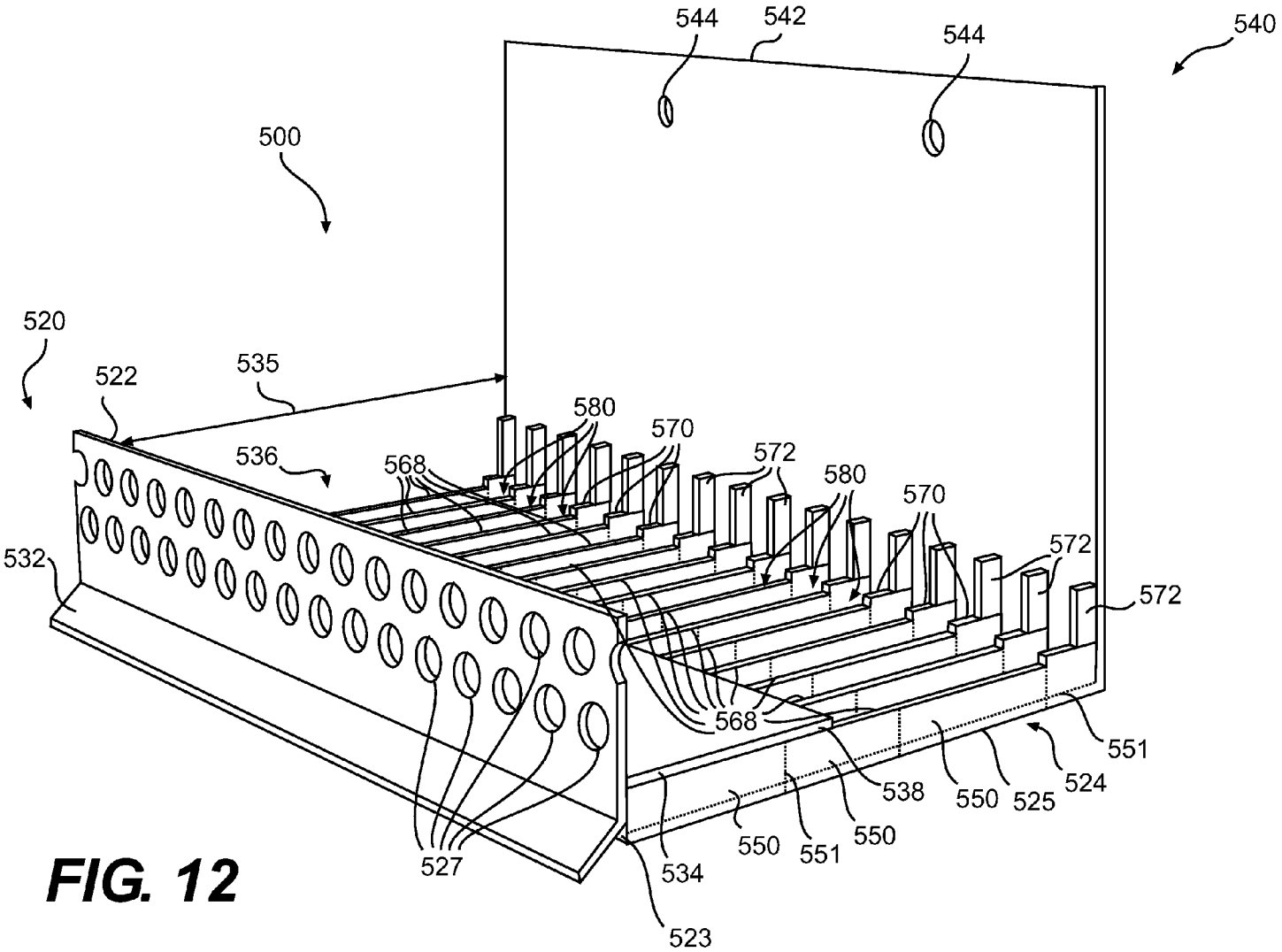
FIG. 12 is a perspective view of yet another casing accessory encompassing aspects of the present disclosure.
Figure 13:
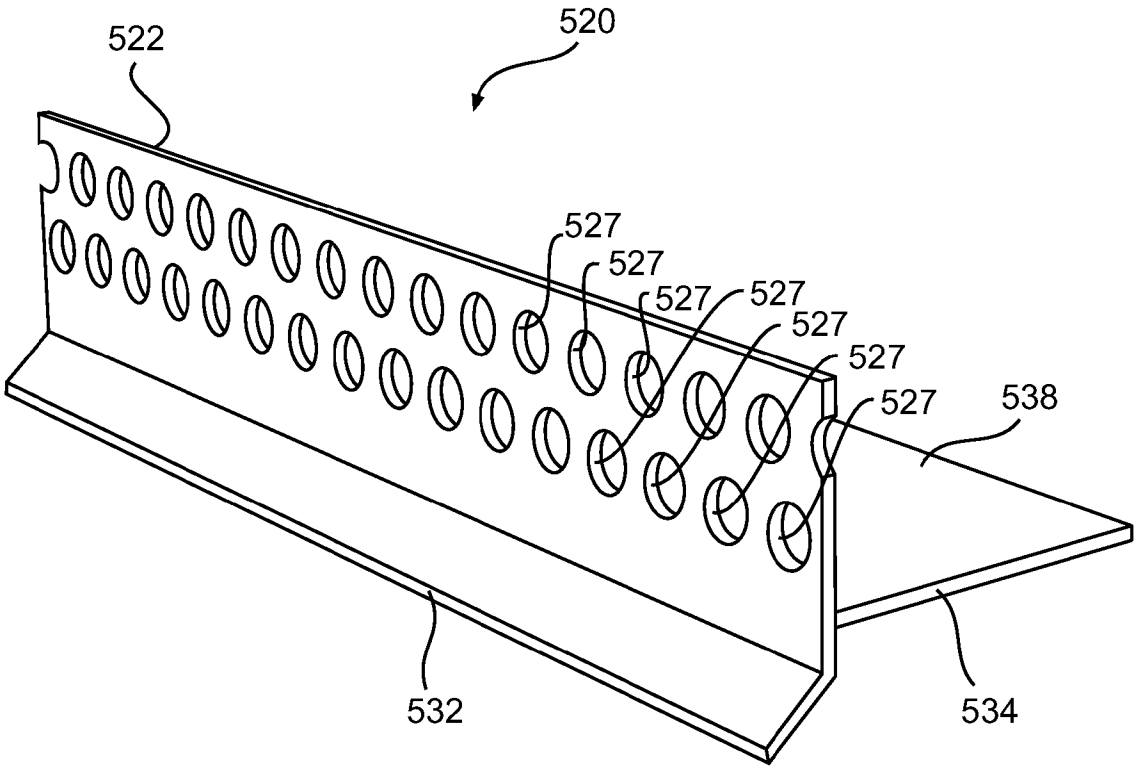
FIG. 13 is perspective view of the front component of the casing accessory shown in FIG. 12.

The front component 520 includes a retaining wall 522 extending a majority of the length of the casing accessory 500. The retaining wall 522 includes a plurality of mating holes 527 formed therein to allow layers of a multi-component wall system disposed on the outside of the retainer wall 522 to adhere to components disposed inside the retaining wall 522. A flange 532 depends from the retaining wall 522 and is angled away from the rear component 540 to allow water and moisture to drain away from the casing accessory 500 and the underlying support structure to which the casing accessory 500 is mounted. The flange 532 extends a majority of the length of the front component 520. The front component 520 also includes a receiver 534 depending from the retaining wall and extending away from the flange 532. The receiver 534 comprises a shelf 538 extending along at least a portion of the length of the front component 520 and can extend the length of the front component 520, as shown in FIG. 12. The receiver 534 engages a spacer 524 integrally formed in the rear component 540. The spacer 524 and the receiver 534 cooperate to establish and maintain the adjustable channel width 535 of the channel 536 formed by the rear component 540 and the front component 520.

Figure 15:
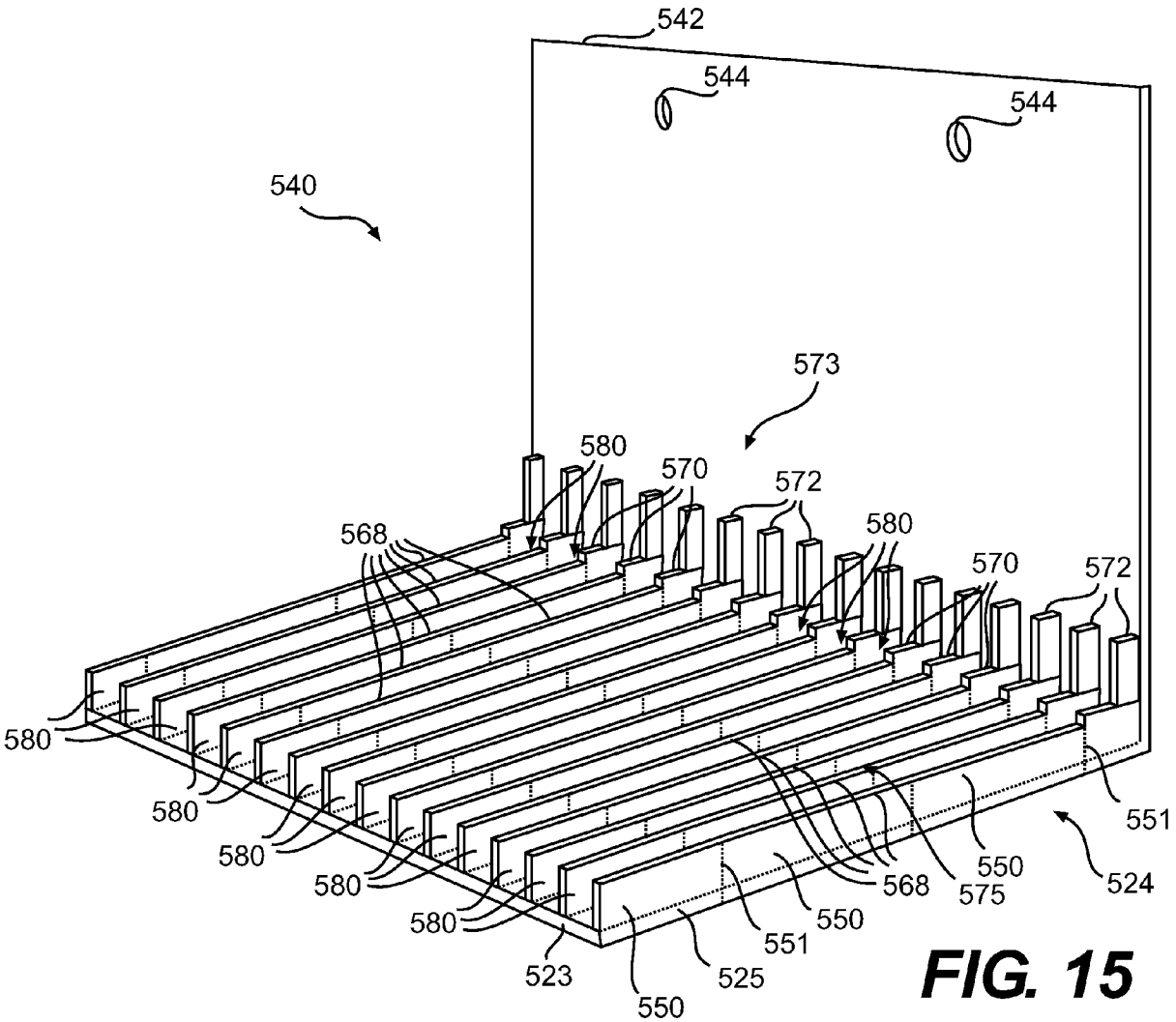
FIG. 15 is a perspective view of the rear component of the casing accessory shown in FIG. 12 with the front component removed.
Figure 16:
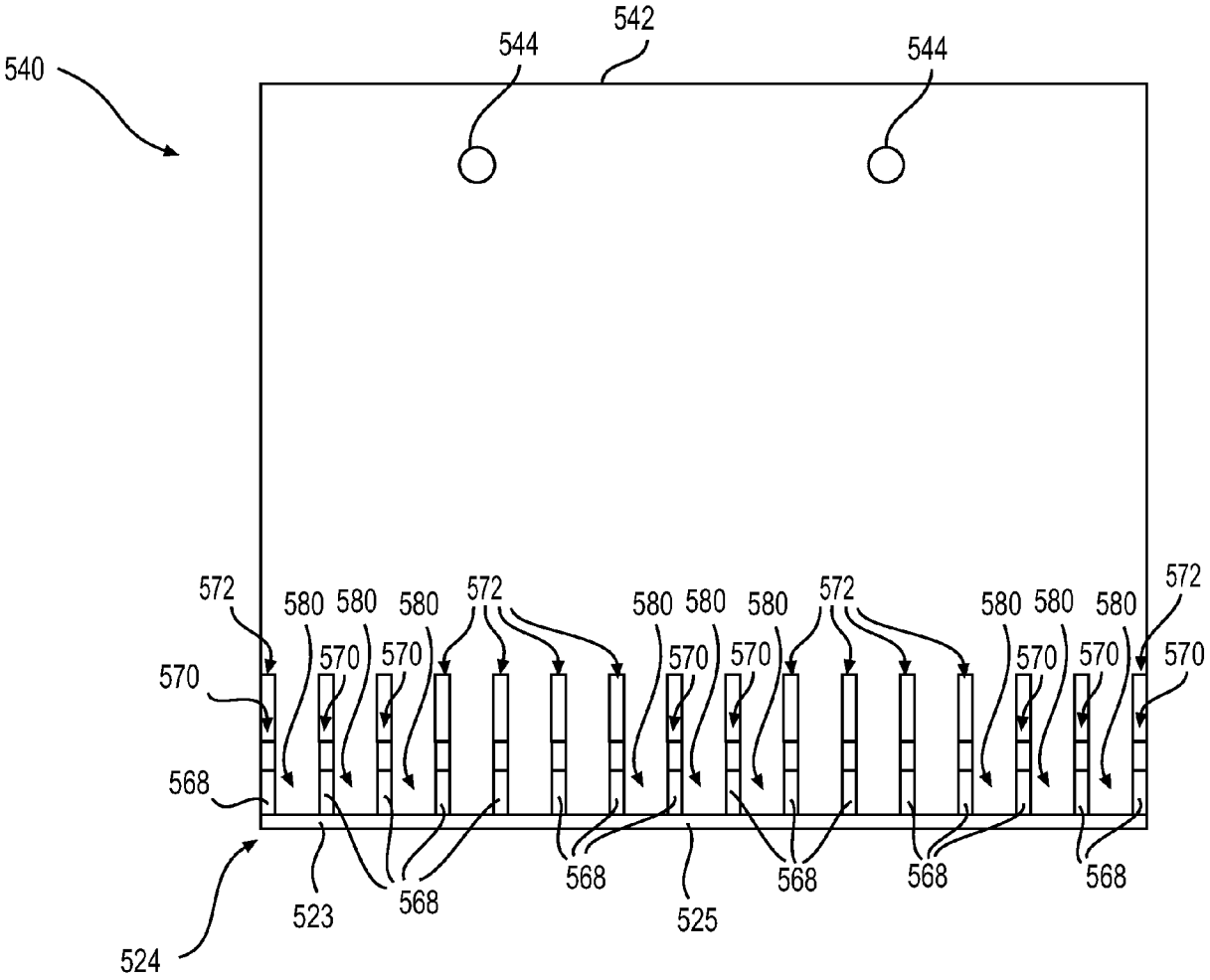
FIG. 16 is a front elevation view of the rear component shown in FIG. 15.

The spacer 524 includes a spacer base 525 that extends from the bottom of the mounting bracket 542 to the front edge 523 of the rear component 540. Extending from the spacer base 525 is a plurality of drainage walls 568 aligned parallel to each other and perpendicular to the length of the channel 536. Each adjoining pair of drainage walls 568 cooperate to form a drainage canal 580 that extends along at least a portion of the spacer 524 and that open at the front edge 523 to allow water or moisture to flow from the mounting bracket 524 out from the front edge 523. The drainage canals 580 open toward and under the retaining wall 522 and the flange 532. As shown in FIGS. 15 and 16, the drainage walls 568 and the adjacent drainage canals 580 extend the width of the base 525 of the spacer 524 and are aligned generally perpendicular to the mounting bracket 542. The plurality of drainage canals 580 are aligned so that water can drain away from the frame or substrate to which the mounting bracket 542 is attached and outward from the multi-component wall system wall of which the casing accessory 500 is a part when installed.

As shown in FIGS. 12 and 15-19, each drainage wall 568 can include a step 570 disposed adjacent the mounting bracket 542 and having a height greater than the remainder of the drainage wall 568. The walls 572 formed adjacent the mounting bracket 542 can cooperate to form an abutment 573 that prevents the components of a multi-component wall system from contacting the mounting bracket 542, and thereby creating a drainage gap 765 between the wall component insulation panel 760 and the underlying wall support structure 770. The top surfaces of the drainage walls 568 cooperate to form a support surface 575 aligned above the drainage canals 580 and which support at least a portion of the receiver 534, such as the shelf 538, and/or a portion of one or more components of a multi-component wall system disposed in the channel 536 of the casing accessory 500 so that the component that is supported is spaced apart from the spacer base 525 and above the drainage canals 580.

Figure 14:
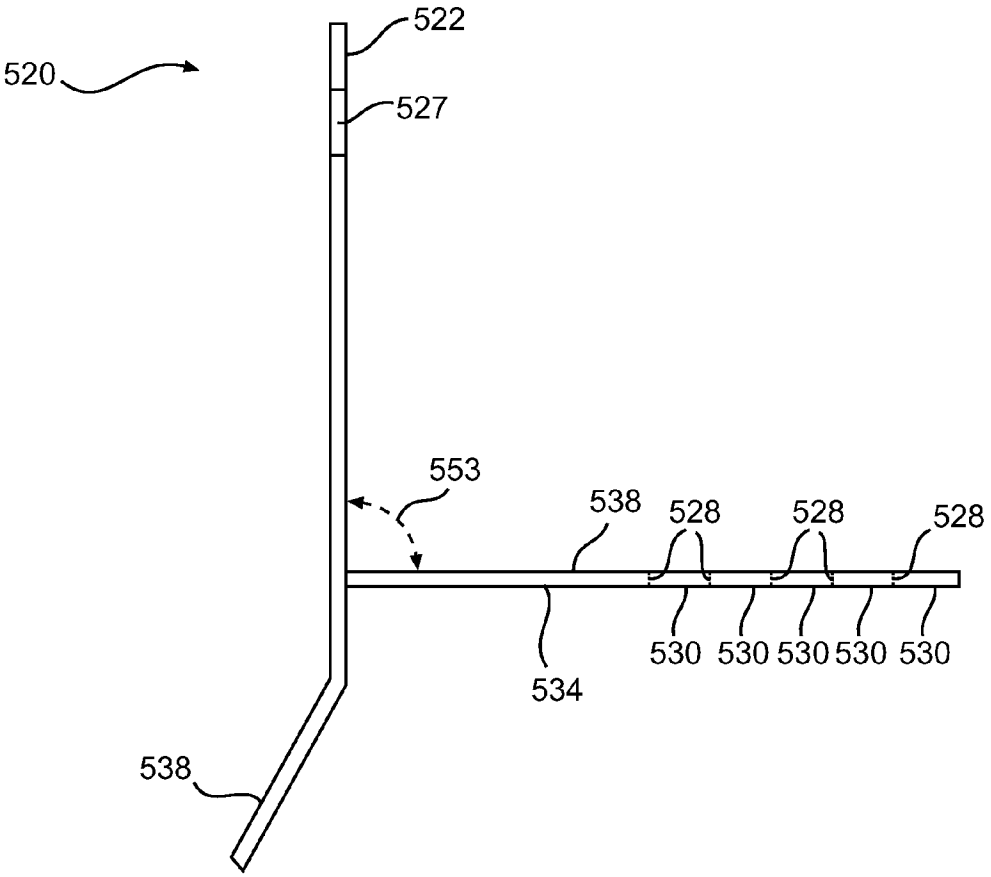
FIG. 14 is a side elevation view of the front component shown in FIG. 13 with width adjusters shown formed thereon.
Figure 17:
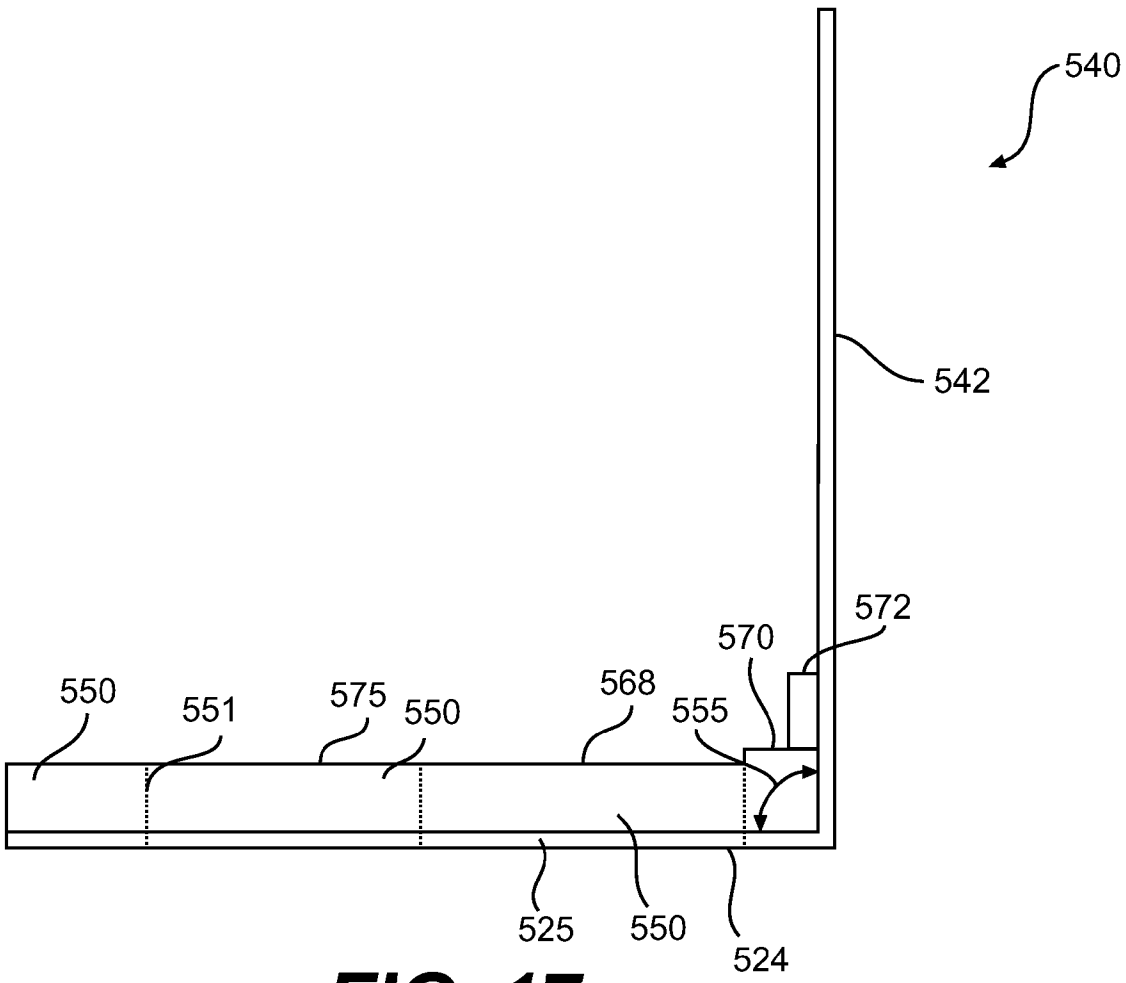
FIG. 17 is a side elevation view of the rear component shown in FIG. 16.
Figure 19:
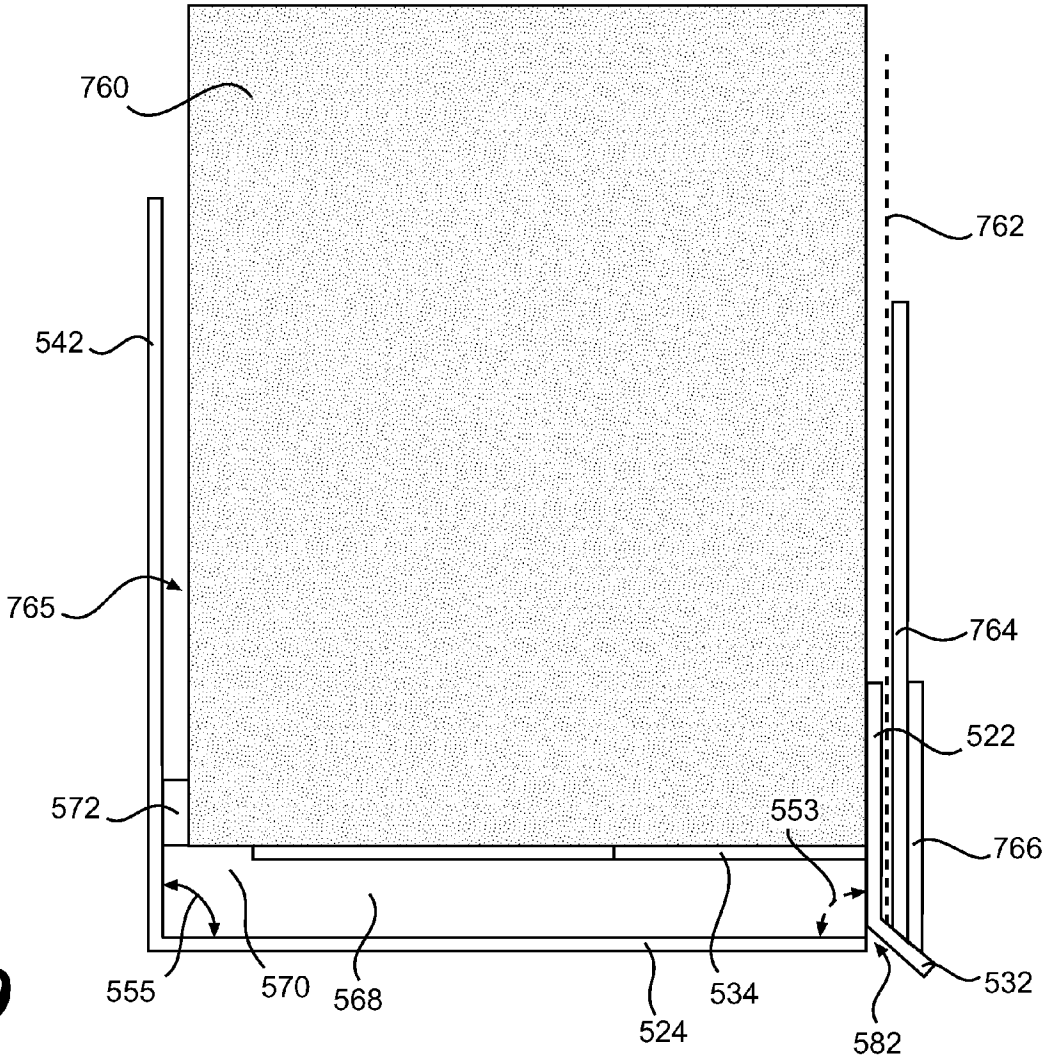
FIG. 19 is side view of the multi-component wall system shown in FIG. 18.

FIGS. 14 and 19 illustrate an angle 553 formed by the retaining wall 522 and the receiver 534 and that is interior to the channel 536 when the front component 520 is operably connected to the rear component 540. The angle 553 can be less than or equal to about 90°. Alternatively, angle 553 can be in the range of about 75° to about 90°. FIGS. 17 and 19 illustrate an angle 555 formed by the mounting bracket 542 and the spacer base 525 and that is interior to the channel 536 when the front component 520 is operably connected to the rear component 540. Angle 553 can be greater than or equal to about 90°. Alternatively, angle 555 can be in the range of about 90° to about 105°. In another aspect, angle 553 can be less than or equal to angle 555. The configuration of the rear component 540 so that angle 555 is greater than about 90° provides a surface of the spacer base 525 at the bottom of each drainage canal 580 to slope down and away from the underlying wall support structure to which the mounting bracket 542 is mounted, thereby allowing water to flow down and away from the wall support structure by gravity.

FIG. 14 illustrates that the receiver 534 can include one or more width adjusters 530 that are formed thereon. The width adjusters 530 can be separated by score lines 528 and are configured to be bent, folded or removed so as to adjust the width of the receiver 534 and thereby adjust the channel width 535 of a channel 536 formed by the cooperation of the receiver 534 with the spacer 524. Accordingly, it should be understood that the present disclosure encompasses casing accessories that include channels having adjustable channel widths that are adjustable by adjustment of either the spacer alone, the receiver alone, or both the receiver and spacer. Furthermore, it should be understood that within the present disclosure the term spacer encompasses structures identified as spacers herein, as well as structures identified as receivers herein and/or combinations thereof.

FIGS. 16 and 17 illustrate the rear component 540 and the aspects of the spacer 524 that allow for adjustment of the width thereof to provide an adjustable channel width 535 of appropriate distance for use in a multi-component wall system and that can adjusted and set at the time of connection of the front component 520 to the rear component 540 by configuring one or more width adjusters 550. The spacer 524 includes a plurality of width adjusters 550 formed therein and which include portions of both the spacer base 525 and the drainage walls 568. The width adjusters 550 are delineated by score lines 551 formed in the spacer 524 and that extend through both the base 525 of the spacer 524 and the drainage walls 568 formed thereon. When a channel 536 of a particular width is desired, the width adjusters 550 can be removed to reduce the spacer 524 to adjust the adjustable channel width 535 to the appropriate width to receive and encase one or more components of a multi-component wall system.

Figure 18:
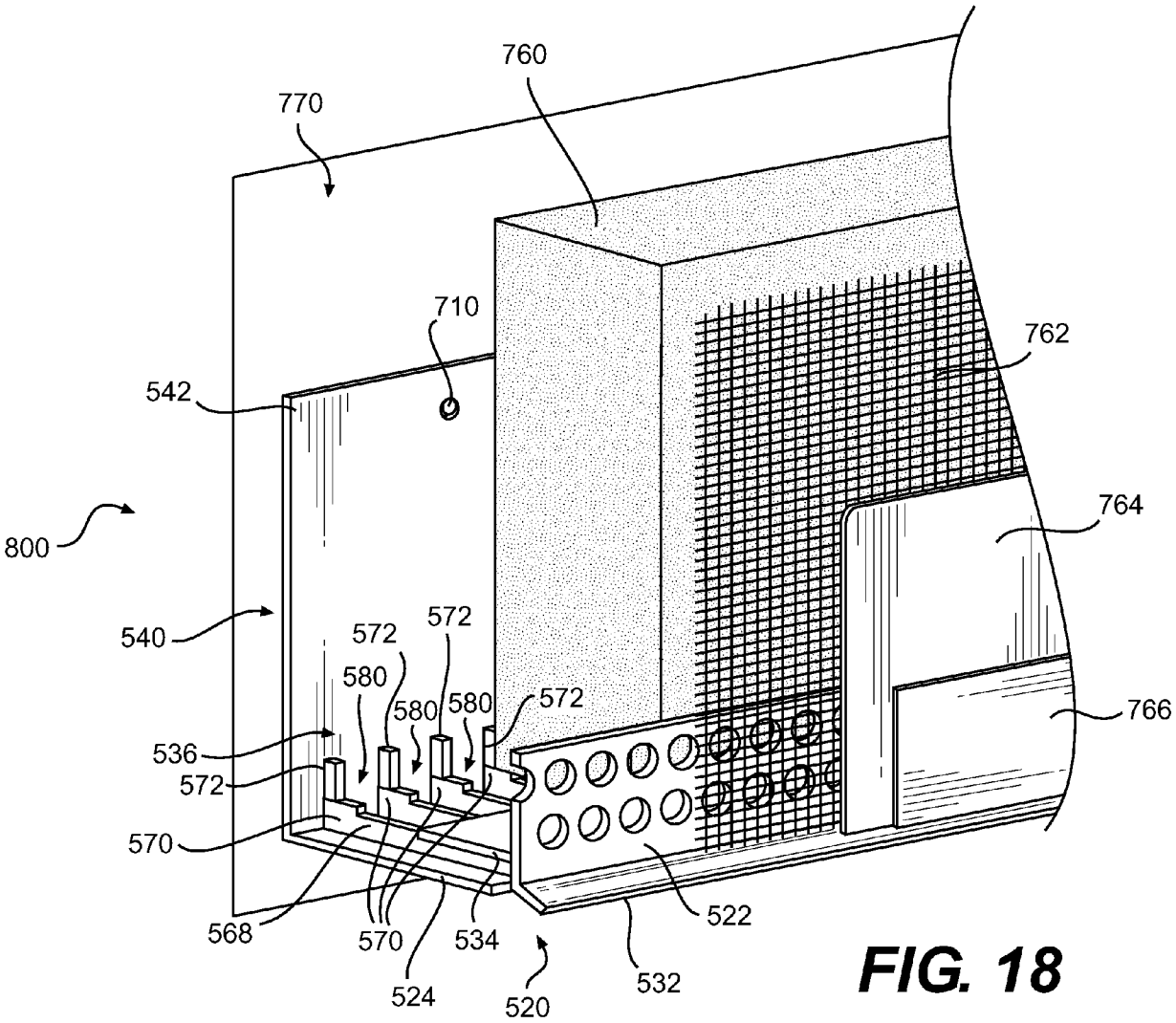
FIG. 18 is a perspective view of the casing accessory shown in FIG. 12 installed in a multi-component wall system and encasing a portion of a component of the multi-component wall system.

FIGS. 18 and 19 shows the casing accessory 500 mounted on an underlying wall support structure 770 and forming a part of a multi-component wall system 800. The casing accessory 500 is mounted to the wall support structure 770 by a fastener 710, such as a nail, disposed in fastener aperture 544 formed in the mounting bracket 542. The mounting bracket 542 is aligned adjacent the wall support structure 770 and the spacer 524 extends outwardly therefrom. The front component 520 is operably connected to the rear component 540 by engagement of the receiver 534 with the spacer 524, such that the receiver 534 is disposed on the support surface 575 formed by the top surfaces of the drainage walls 568, thereby creating a support structure for holding an edge of the insulation panel 760. The spacer 524 and the receiver 534 cooperate to form the base of the channel 536 formed by the casing accessory 500. The drainage canals 580 formed between the drainage walls 568 are disposed at the base of the channel 536 below the continuous insulation panel 760. A mesh layer 762 is disposed on both the continuous insulation panel 760 and the retaining wall 522 of the front component 520. Additional layers 764 and 766 are disposed over the other components of the system. When installed, the insulation panel 760 can be rested on top of the steps 570 formed on the drainage walls 568 adjacent the mounting bracket 542, thereby forming a gap below the bottom of the insulation panel 760 and the top of the drainage walls 568 to allow for the insertion of the receiver 534 of the front component 520 between the insulation panel 760 and the drainage walls 568. When the insulation panel 760 is so aligned in the channel 536 with a gap 765 in between the rear face of the insulation panel and the mounting bracket 542, water and moisture can flow downward by gravity from within the multi-component wall system 800 through the drainage gap 760 to the drainage canals 580. The water can then flow outward to the second ends of the drainage canals 580 through openings 582 disposed behind the retaining wall 522 and the flange 532, and thus outward to the exterior of the multi-component wall system 800. Angle 555 can be greater than about 90° so that water tends to flow away from the mounting bracket 542 and underlying support structure toward the openings 582.

Figure 20:
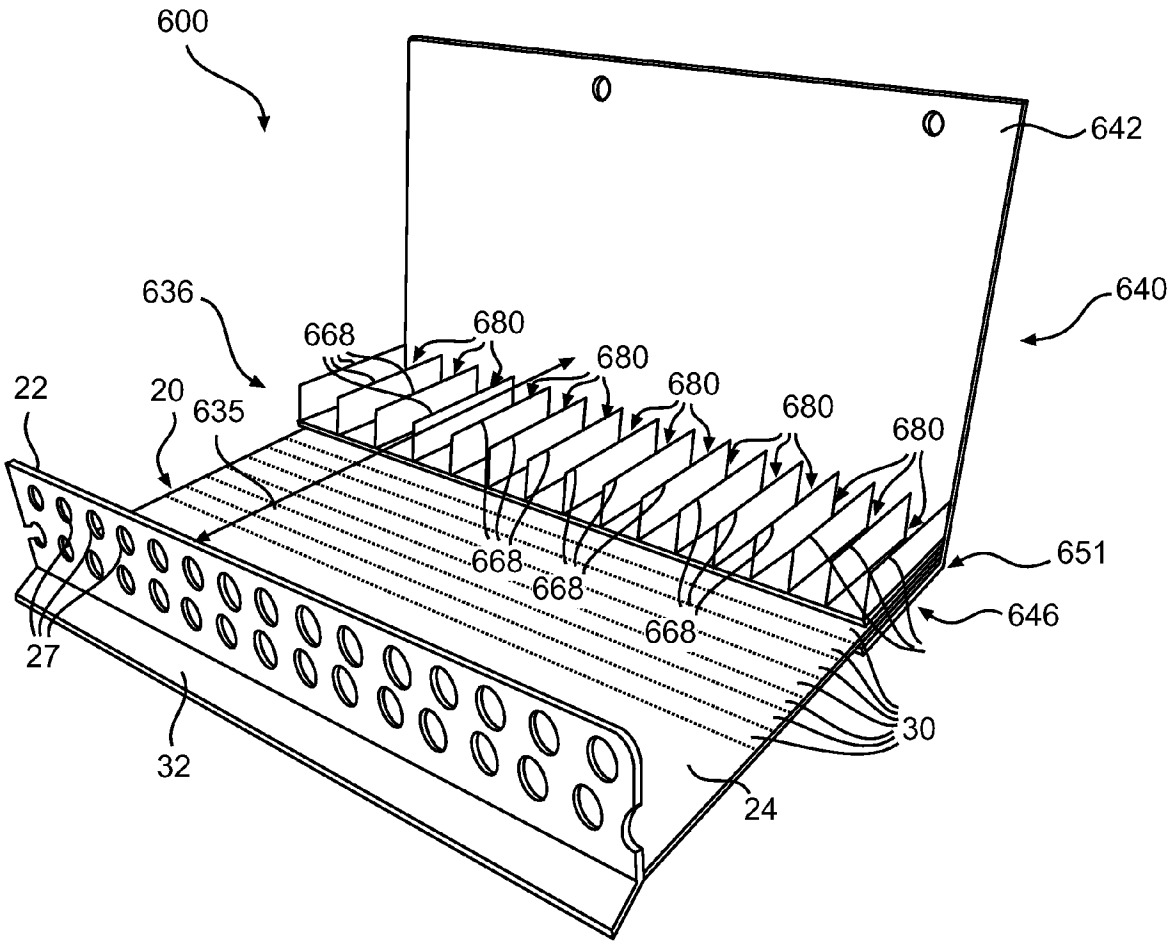
FIG. 20 is a perspective view of yet another casing accessory encompassing aspects of the present disclosure.
Figure 21:
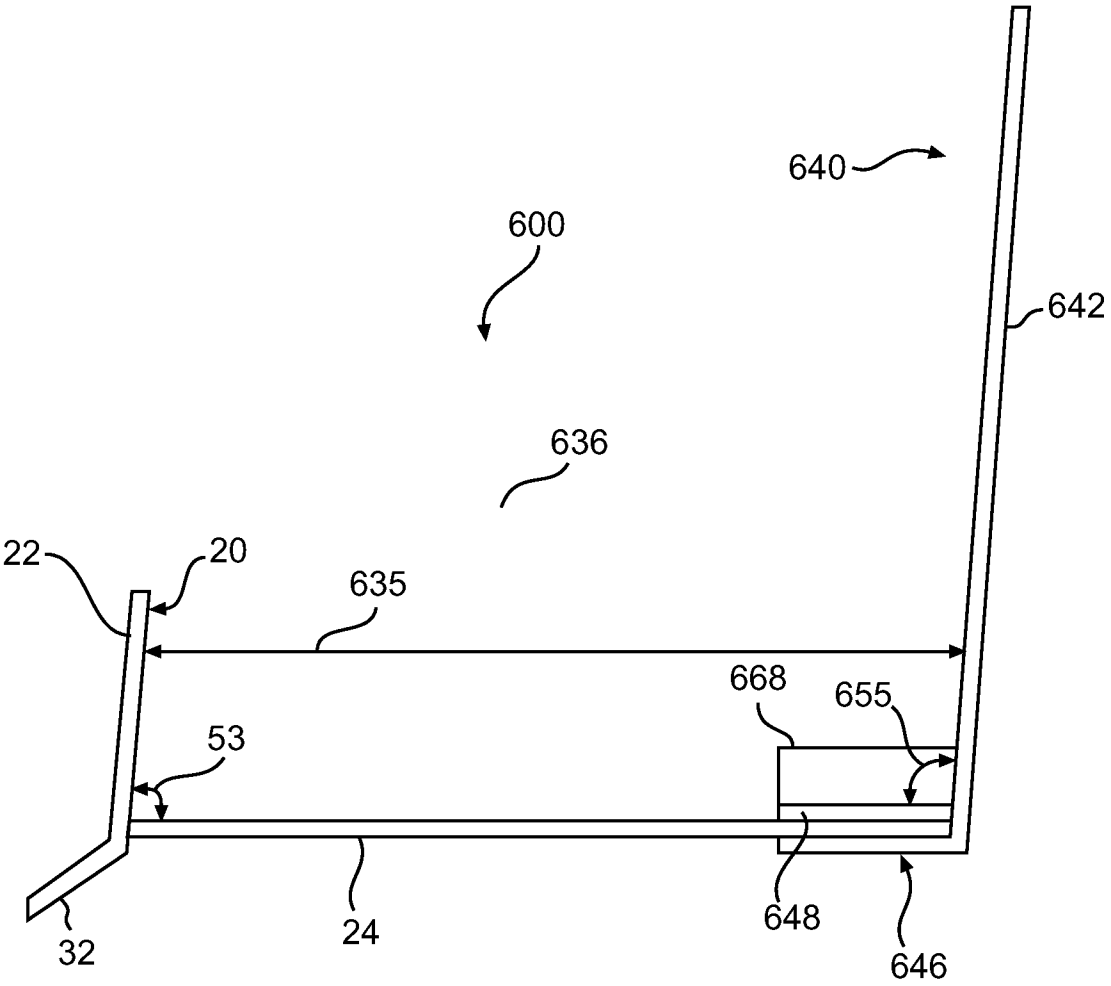
FIG. 21 is a side elevation view of the casing accessory shown in FIG. 20.

FIGS. 20 and 21 illustrate yet another embodiment of a casing accessory 600 encompassing aspects of the present disclosure. The front component 20 is the same as that shown in FIGS. 1 and 3. However, the rear component 640 differs from the other embodiments of rear components shown in the drawings in that the rear component 640 includes a receiver 646 that has a plurality of drainage walls 668 and drainage canals 680 formed thereon. More specifically, the drainage walls 668 extend upward from the top wall 648 of the receiver 646 and are spaced apart from each other in order to form the drainage canals 680 there between. The angle 655 formed by the mounting bracket 642 and the top wall 648 is greater than the angle 53 formed by the retaining wall 22 and the spacer 24 so as to allow water or moisture to drain away from the mounting bracket 642 toward the drainage holes 26 formed in the spacer 24.

The components of the casing accessories of the present disclosure can be formed by methods known in the art, such as extruding, pultruding, stamping, cast forming and other methods, and can be made from materials such as aluminum, steel, other metals, polyvinyl chloride, coated PVC, pultruded fiber glass, and other materials that provide desired rigidity, flexibility, weight, corrosion resistance, compatibility with coatings, and fire resistance. In one aspect, the casing accessories encompassed by the present disclosure can be formed of one or more fire-resistant materials, such as metal or fiberglass, to impart enhanced resistance to fire to the multi-component wall system in which the casing accessory is used. The casing accessories of the present disclosure can be formed to varying lengths during manufacture or cut to the appropriate length at the installation site.

The casing accessories encompassed by the present disclosure can include spacers that include one or more of the structural and/or functional aspects of the receivers described herein, as well as receivers that serve as, either singly or in combination with one or more components of the casing accessory, spacers and can have width adjusters formed thereon or incorporated therein. Furthermore, two or more structures, such as one or more receivers and one or more spacers, can function as or cooperate to function as a spacer as set forth in the present disclosure. The spacers of the casing accessories encompasses by the present disclosure can be detachably connected to one or both of the front and rear components thereof, and, alternatively, be integrally formed with one of these such components.

The casing accessories of the present disclosure can include receivers with combinations of the characteristics described in detail above and alternatives thereto. While receivers with two walls and a slot formed there between, and two steps forming a seat have been described and shown in the drawings, other receiver configurations that are used to connect the front component to the rear component of the accessory are encompassed by the present disclosure. For example, the receiver can include one leg, or legs of varying widths, or various fastening mechanisms by which the spacer can be attached to the other component of the accessory.

Alternative configurations of the casing accessories of the present disclosure are contemplated and encompassed hereby. For example, rather than the spacer being formed in the front component and integrally formed with the retaining wall and the receiver integrally formed with the mounting bracket, the present disclosure encompasses casing accessories that include spacers and receivers that are switched, in that the spacer is integrally formed with the mounting bracket and the receiver is integrally formed with the retaining wall. Another alternative configuration includes a front component with spacer that is not continuous along its length. In this alternative, rather than strips extending along the entire length of the spacer, the strips can be intermittent along the length. In one aspect, the spacer can be integrally formed with only one of the rear component and the front component. In another aspect, the spacer can be manufactured separately from the mounting bracket and the retaining wall and then connected to both after manufacturing to provide an accessory with a channel with a desired width. In another aspect, the width adjusters of the casing accessories encompassed by the preset disclosure can be configured to be detached from the rest of the accessory or deformed, such as by folding or bending, to adjust the width of the spacer, thereby resulting in the adjustment of the channel width to the appropriate distance. In a further aspect, the present disclosure encompasses an adjustable component formed in the receiver such that adjustment of the receiver results in the adjustment of the adjustable channel width of the channel formed in the casing accessory. These and other alternative configurations are contemplated by the present disclosure.

It will be apparent to those skilled in the art that various modifications and variations can be made to the starter tracks set forth herein and are contemplated by the present disclosure.

What is claimed is:

1. A casing accessory for a multi-component wall system comprising:

a front component comprising a retaining wall;

a rear component operably connected to the front component, wherein the rear component comprises a mounting bracket, and wherein the mounting bracket is aligned proximal to a wall support structure when the casing accessory is mounted to the wall support structure;

a spacer extending at least a portion of a distance between the mounting bracket and the retaining wall, and wherein the spacer maintains spacing between the retaining wall and the mounting bracket when the casing accessory is mounted to the wall support structure;

wherein the retaining wall, the spacer, and the mounting bracket cooperate to form a channel for encasing a portion of a component of a multi-component wall system, wherein the channel comprises an adjustable channel width and wherein the adjustable channel width is adjustable by adjustment of the spacer; and, a plurality of drainage canals disposed in the channel, wherein each drainage canal of the plurality of drainage canals comprises a first end aligned proximal to the mounting bracket and a second end aligned distal to the mounting bracket.

2. The casing accessory of claim 1, wherein the spacer comprises a width adjuster formed thereon, wherein the adjustable channel width is adjustable by adjustment of the width adjuster.

3. The casing accessory of claim 2, wherein the spacer comprises a plurality of the width adjusters formed thereon.

4. The casing accessory of claim 2, wherein the width adjuster comprises a detachable member, and wherein the adjustable channel width is adjustable by removing the detachable member from the spacer.

5. The casing accessory of claim 1, wherein the mounting bracket and the spacer form a first angle, and wherein the retaining wall and the spacer form a second angle, and wherein the second angle is less than the first angle.

6. The casing accessory of claim 1, wherein at least a portion of each drainage canal of the plurality of drainage canals is disposed on a receiver formed in the rear component.

7. The casing accessory of claim 1, wherein the retaining wall comprises a mesh layer.

8. The casing accessory of claim 1, further comprising an abutment disposed in the channel and wherein the abutment separates the portion of the component of the multi-component wall system from the mounting bracket when the portion of the component is disposed in the channel.

* * * * *